US007743581B2

(12) United States Patent
Shaw et al.

(10) Patent No.: US 7,743,581 B2
(45) Date of Patent: Jun. 29, 2010

(54) CORNICE CORNER CAP AND METHODS RELATED THERETO

(75) Inventors: Robert D. Shaw, Parma, MI (US); Robert W. Werner, Howell, MI (US)

(73) Assignee: CertainTeed Corporation, Valley Forge, PA (US)

( * ) Notice: Subject to any disclaimer, the term of this patent is extended or adjusted under 35 U.S.C. 154(b) by 0 days.

(21) Appl. No.: 12/475,687

(22) Filed: Jun. 1, 2009

(65) Prior Publication Data

US 2009/0235612 A1 Sep. 24, 2009

Related U.S. Application Data

(62) Division of application No. 11/556,423, filed on Nov. 3, 2006, now Pat. No. 7,591,118.

(60) Provisional application No. 60/734,034, filed on Nov. 4, 2005.

(51) Int. Cl.

| | |
|---|---|
| ***E04B 2/00*** | (2006.01) |
| ***E04B 5/00*** | (2006.01) |
| ***E04F 19/04*** | (2006.01) |
| ***B44F 7/00*** | (2006.01) |

(52) U.S. Cl. ..... 52/741.1; 52/287.1; 52/290; 52/312; 52/716.8; 52/718.01

(58) Field of Classification Search ..... 52/287.1, 52/288.1, 290, 312, 716.8, 718.01, 718.04, 52/741.1

See application file for complete search history.

(56) References Cited

U.S. PATENT DOCUMENTS

| | | | | |
|---|---|---|---|---|
| 3,074,521 | A * | 1/1963 | Woods | 52/288.1 |
| 4,015,391 | A | 4/1977 | Epstein | |
| 4,608,794 | A | 9/1986 | Delise | |
| 4,998,947 | A | 3/1991 | Dostall et al. | |
| 5,001,877 | A | 3/1991 | Edwards | |
| 5,199,237 | A | 4/1993 | Juntunen | |
| 5,625,992 | A | 5/1997 | Strick et al. | |
| 5,651,224 | A | 7/1997 | Brabant | |
| 5,729,933 | A | 3/1998 | Strength | |
| 5,802,790 | A | 9/1998 | Lamont et al. | |
| 5,809,718 | A | 9/1998 | Wicks | |
| 5,829,206 | A | 11/1998 | Bachman | |
| 5,875,602 | A | 3/1999 | Lappin et al. | |
| 5,924,259 | A * | 7/1999 | Marousek | 52/656.1 |
| 5,966,891 | A | 10/1999 | Fagan et al. | |
| 6,047,507 | A | 4/2000 | Lappin et al. | |
| D427,333 | S * | 6/2000 | Anderson et al. | D25/164 |
| 6,125,605 | A | 10/2000 | Young | |
| 6,216,407 | B1 | 4/2001 | LeBlanc | |
| 6,318,039 | B1 | 11/2001 | Watson et al. | |

(Continued)

*Primary Examiner*—Richard E Chilcot, Jr.
*Assistant Examiner*—Branon C Painter
(74) *Attorney, Agent, or Firm*—Duane Morris LLP

(57) ABSTRACT

A method of using an assembly and a method of finishing an uppermost course of siding installed at a corner of a building with a cornice molding. A cornice molding cap is provided as an accessory to cover or eliminate gaps created where cornice molding meets at a corner of a building. The cap covers gaps where cornice molding meets at a corner structure formed by two walls. The cap is particularly useful in exterior siding installations at corners not employing corner posts having receiver pockets for cladding material end edges.

6 Claims, 21 Drawing Sheets

U.S. PATENT DOCUMENTS

| | | | | |
|---|---|---|---|---|
| 6,341,458 | B1 | 1/2002 | Burt | |
| D454,648 | S | 3/2002 | Shaw et al. | |
| D456,089 | S | 4/2002 | Shaw et al. | |
| 6,385,927 | B2 | 5/2002 | Schiedegger et al. | |
| D472,333 | S | 3/2003 | Shaw | |
| 6,553,732 | B2 | 4/2003 | Shaw | |
| 6,643,990 | B2 * | 11/2003 | Jensen | 52/716.1 |
| 6,684,587 | B2 | 2/2004 | Shaw | |
| 2001/0045076 | A1 * | 11/2001 | Boomer | 52/716.1 |
| 2003/0140583 | A1 * | 7/2003 | Sauter | 52/220.7 |
| 2003/0226327 | A1 | 12/2003 | Perry | |
| 2004/0168384 | A1 * | 9/2004 | Wesolowska | 52/287.1 |
| 2005/0210784 | A1 | 9/2005 | Hahn | |

* cited by examiner

CORNICE CORNER CAP AND METHODS RELATED THERETO

CROSS REFERENCE TO RELATED APPLICATION

This application is a Divisional application of U.S. patent application Ser. No. 11/556/423, filed Nov. 3, 2006, now U.S. Pat. No. 7,591,118 which claims the benefit of provisional application no. 60/734,034, Filed Nov. 4, 2005.

FIELD OF THE INVENTION

The present invention relates to siding products generally, and more particularly relates to trim components for finishing corners of siding installations at an uppermost course adjacent to a soffit.

BACKGROUND

Various types of siding panels have long been used to clad the exteriors of buildings. Polymer based sidings, such as vinyl or polypropylene, have become very popular exterior finishing products primarily due to its relatively low cost and durability when compared to traditional materials such as wood or metal. Fiber cement siding products have also become very popular. In addition, polymeric and fiber cement siding products can also be provided in a wide variety of colors and patterns. Polymeric siding has an advantage in that it is more flexible and forgiving, and hence, will not deform plastically under minor impact loads. Polymeric siding is also easy to machine and cut and can be worked with common hand tools at the construction site.

While the installation of exterior siding panels is relatively straightforward, installing siding as corner structures of the building requires more labor and expertise. Common finishing techniques for siding construction at corner structures involve the placement of corner accessories around a corner structure. For siding panels simulating a clapboard installation, typical corner accessories are corner posts with receiver pockets for concealing the ends of the courses of siding panels near the wall corner. The receiver pocket also allows for a margin of safety in spacing the ends of the siding panels from an abutment to accommodate thermal expansion of the siding panels and protects the end of the wall of the siding installation from water intrusion.

Wooden shingles and shakes are another class of very popular and attractive siding products used in the construction of homes, businesses and other structures. Unfortunately, these wooden products require constant maintenance, and are extremely expensive, as well as labor intensive to install. Further, as noted above, the durability of wooden products, such as those constructed from cedar, lags far behind that of products made of synthetic materials. Because of the popularity of the aesthetics of wood shingles and shakes, a considerable number of synthetic siding products have been created that simulate the wooden appearance of, for example, cedar shingles or cedar shake shingles. These siding products are typically formed from materials such as polyvinyl chloride and polypropylene. There are also fiber cement products available that simulate shale shingles.

Once siding panels are installed onto the exterior sheathing of a structure, it often becomes necessary to place a siding corner piece over the exposed ends of the siding panels. As an alternative to a conventional corner post with a receiver pocket, efforts have been made to match the ornamental appearance of the siding panel with the corner piece appearance, so as to avoid an unaesthetic or artificial looking final structure. Examples include the simulated shake siding corners described in U.S. Pat. No. 4,015,391 to Epstein, et al. entitled "Simulated Cedar Shake Construction," and U.S. Pat. No. 6,684,587 to Shaw, et al. entitled "Cedar Impression Siding Corner, the entireties of both of which are hereby incorporated by reference herein. Both Epstein and Shaw describe simulated cedar shake siding panels that are attached to the outside walls of a structure and a corner piece that may be used in conjunction with shake impression siding panels to provide the look of a corner having finished shakes with mitered joints.

As the siding installation process proceeds up the wall to the soffit, it will often be the case that a course of siding will need to be trimmed horizontally to the appropriate dimension to fit on the wall. A trim accessory piece is desirable to produce an aesthetically pleasing transition from the siding installed vertically up the wall to the soffit that meets the siding under the eave of the roof. This transition can be provided by installation of a cornice receiver strip above the upper edge of the uppermost siding panel adjacent the soffit area. A cornice molding strip is then installed in the receiver for covering the upper edge of the uppermost siding panel and producing an aesthetically pleasing transition to the soffit.

In cases where a corner post having a receiver pocket is used in the siding installation, the ends of the trim pieces will be concealed within the receiver pocket. However, for more decorative corners simulating shake impressions, such as, for example, U.S. Pat. No. 4,015,391 to Epstein and U.S. Pat. No. 6,684,587 to Shaw, there is no pocket to conceal the end of trim. In order to attain an aesthetically pleasing corner of the trim accessory, another approach is necessary.

One approach would be to trim the ends of the cornice molding to produce a mitered corner joint. However, this process is laborious and time consuming and requires special carpentry skills. It also would yield a tightly fitted corner joint that could be damaged by distortion caused by thermal expansion and contraction with dimensional changes of a polymeric cornice molding trim accessory.

Another approach is for the contractor in the field to finish the cornice molding at the outside corner by fabricating a corner cap out of coated aluminum coil and mounting it over the ends of the cornice molding strips at the corner structure adjacent the soffit. This approach, while potentially providing space to allow for a rougher end cutting of the cornice trim and allowing for dimensional changes of the strip, suffers from the need for time, labor, and special skills in metal working to produce an aesthetically pleasing corner cap. Also, an aluminum cap could be susceptible to denting and permanent deformation or other damage or dislodgement by impacts or winds. These difficulties have led some users to avoid the use of siding products that do not employ corner posts having siding receiver pockets and avoiding the use of exposed polymer based cornice molding strips that require a mitered joint finish at the corner.

Therefore, there remains a need for a corner piece that provides the appearance of a more natural termination of the cornice molding trim strip above the uppermost course of a siding installation employing an aesthetic corner piece, and a corner piece that is easy to use and install that accommodates thermal expansion and contraction of the trim strip and is less susceptible to damage or displacement by impacts or winds.

SUMMARY OF THE INVENTION

In embodiments of the present invention, a preformed cornice molding corner cap is provided for use in conjunction with a cornice molding strip as a part of an exterior siding installation at a corner structure provided by two mating walls. The corner cap is of unitary construction and has a top and bottom, a decorative exterior and an interior, an upper surface and a lower surface, and upper and lower retainer flanges. The cap includes first and second decorative exterior surfaces meeting at a corner, the exterior surfaces being aesthetically of complementary shape to a cornice molding trim accessory strip. The corner cap also includes first and second interior surfaces, the profiles of which are physically of complementary shape to the outer surface of the cornice molding accessory so as to receive an end of a cornice molding strip within the interior of the cornice molding corner cap.

The cornice molding corner cap cooperates with the cornice molding strip to cover the gap between cornice molding strips attached to adjacent walls mating at a corner structure, to give the appearance of a finished mitered corner of the decorative molding, and to cover the upper edge of an uppermost course of siding panel and siding corner piece, and to align ends of the cornice molding strips horizontally with each other and/or against an underside of a soffit under an eve of a roof.

In certain embodiments, the present invention also provides a method of finishing a corner of an uppermost course of a siding installation. In the method, an uppermost courses of siding panels on each of two adjacent walls that meet at a corner structure are installed, a siding corner piece is installed at the corner structure, first and second cornice molding strips are installed on each of the walls above the top edge of the uppermost courses of siding panels under an eave or soffit structure, with the ends of the cornice molding strips having a gap between them adjacent the corner and a gap between an end of each molding strip and the edge of the corner structure. A preformed cornice molding corner cap is provided and the corner cap is installed over the ends of each of the cornice molding strips, thereby concealing the gap between the ends of the cornice molding strips and between the ends of the strips and the edge of the corner structure, thus effectively covering the corner. In some instances when installing the cornice molding corner cap, the upper retainer flange of the cornice molding corner cap is hooked over the top edge of ends of the first and second cornice molding strips and the lower retainer flange is pivoted downward to become snap-fit and hooked under the bottom edge of the cornice molding strips to mount the cap in place in a snap-fitting relation. In other instances, the cornice molding corner cap is installed by sliding the cornice molding corner cap over the end of the first cornice molding strip until the cap overlaps and aligns with the surface of the second cornice molding strip adjacent to the corner, and snap inserting the second cornice molding strip into the interior of the corner cap by biasing the retaining flanges against the second cornice molding strip to widen a receiver channel for receiving the second cornice molding strip.

In certain embodiments, the present invention also provides a system and an assembly for the finishing of a corner of a siding installation having an uppermost course of siding on each of two adjacent walls that meet at a corner structure, a siding corner piece installed at the corner structure, and first and second cornice molding strips installed on each of the walls above the top edges of the uppermost courses of siding panels under an eave or soffit structure, with the ends of the cornice molding strips having a gap between them adjacent the corner. The system and the assembly further include a preformed cornice molding corner cap installed over the ends of each of the two cornice molding strips at the corner structure, thereby concealing the gaps between the ends of the cornice molding strips and covering the corner. The cornice molding corner cap accommodates thermal expansion of the cornice molding strip and is resistant to displacement. The corner cap also acts to create a barrier at the joint of the cornice molding trim to minimize intrusion of water or insects into the building structure at the top of the wall corner.

The preformed cornice molding corner cap, method, system and assembly enable easy finishing of corners of siding installations employing shake shingle impression siding, as well as, other siding installations employing finished corner pieces without the use of a corner post having a receiver pocket for siding panel ends. The preformed cornice molding corner cap is useful for trim applications on buildings clad with polymeric siding such as vinyl or polypropylene, fiber cement siding, or other types of siding, cladding or sheathing where a finished mitered corner trim appearance is desired.

Embodiments according to the invention include, but are not limited to the several embodiments of the invention that will now be described.

An article of manufacture comprises a unitary cornice molding corner cap having a top and a bottom, and an interior and an exterior, a top receiver flange and a bottom receiver flange, the cap being capable of receiving a first end of each of a first and second cornice molding strips within the interior of the cornice molding cap.

An article as described above wherein the cornice molding cap further comprises an injection molded cap formed from a material comprising a polymer selected from the group consisting of polyvinylchloride polymers and copolymers, polypropylene polymers and copolymers, acrylonitrile butadiene styrene copolymers, acrylonitrile styrene acrylate copolymers and mixtures thereof.

A method of finishing a corner of an uppermost course of a siding installation, the method comprising the steps of installing the uppermost course of siding on each of two adjacent walls, the walls meeting at a corner structure; installing a siding corner piece at the corner structure; installing a first and a second cornice molding strip on each of the walls over a top edge of the uppermost course of siding panels, the top edge being under an eave or soffit structure, each of the first and second cornice molding strips having a first end proximate the corner structure, there being a gap between the first ends and the corner structure and a gap between the first ends of the first and second cornice molding strips; providing a cornice molding corner cap having a top and a bottom, and an interior and an exterior, and capable of accommodating the first end of each of the cornice molding strips within the interior of the cornice molding cap; and, installing the corner cap over the ends of each of the cornice molding strips, thereby concealing the gaps between the ends of the cornice molding strips.

In another embodiment of a method of finishing a corner of an uppermost course of a siding installation, the method comprises the steps of installing the uppermost course of siding on each of two adjacent walls, the walls meeting at a corner structure; installing a siding corner piece at the corner structure; installing a first and a second cornice molding strip on each of the walls over a top edge of the uppermost course of siding panels, the top edge being under an eave or soffit structure, each of the first and second cornice molding strips having a first end proximate the corner structure, there being a gap between the first ends and the corner structure and a gap between the first ends of the first and second cornice molding strips; providing a cornice molding corner cap having a top and a bottom, and an interior and an exterior, and capable of accommodating the first end of each of the cornice molding strips within the interior of the cornice molding cap; and, installing the corner cap over the ends of each of the cornice molding strips, thereby concealing the gaps between the ends of the cornice molding strips, the method further comprising attaching a cornice receiver to each of the adjacent walls; snapping the cornice molding into the cornice receiver; hooking the top of the cornice molding corner cap over the ends of the first and second cornice molding strips and snapping the bottom of the cornice molding cap into place.

In yet another embodiment of a method of finishing a corner of an uppermost course of a siding installation, the method comprises the steps of installing the uppermost course of siding on each of two adjacent walls, the walls meeting at a corner structure; installing a siding corner piece at the corner structure; installing a first and a second cornice molding strip on each of the walls over a top edge of the uppermost course of siding panels, the top edge being under an eave or soffit structure, each of the first and second cornice molding strips having a first end proximate the corner structure, there being a gap between the first ends and the corner structure and a gap between the first ends of the first and second cornice molding strips; providing a cornice molding corner cap having a top and a bottom, and an interior and an exterior, and capable of accommodating the first end of each of the cornice molding strips within the interior of the cornice molding cap; and, installing the corner cap over the ends of each of the cornice molding strips, thereby concealing the gaps between the ends of the cornice molding strips, the method further comprising sliding the cornice molding corner cap over the first end of the first cornice molding strip; aligning the corner cap with the first end of the second cornice molding strip; and, inserting the first end of the second cornice molding strip into the interior of the corner cap.

In yet another embodiment of a method of finishing a corner of an uppermost course of a siding installation, the method comprises the steps of installing the uppermost course of siding on each of two adjacent walls, the walls meeting at a corner structure; installing a siding corner piece at the corner structure; installing a first and a second cornice molding strip on each of the walls over a top edge of the uppermost course of siding panels, the top edge being under an eave or soffit structure, each of the first and second cornice molding strips having a first end proximate the corner structure, there being a gap between the first ends and the corner structure and a gap between the first ends of the first and second cornice molding strips; providing a cornice molding corner cap having a top and a bottom, and an interior and an exterior, and capable of accommodating the first end of each of the cornice molding strips within the interior of the cornice molding cap; and, installing the corner cap over the ends of each of the cornice molding strips, thereby concealing the gaps between the ends of the cornice molding strips, wherein the providing step comprises molding the corner cap from a material comprising a polymer selected from the group consisting of polyvinylchloride polymers and copolymers, polypropylene polymers and copolymers, polyethylene polymers and copolymers, acrylonitrile butadiene styrene copolymers, acrylonitrile styrene acrylate copolymers, acrylate ethylene styrene copolymers, and mixtures thereof.

In yet another embodiment of a method of finishing a corner of an uppermost course of a siding installation, the method comprises the steps of installing the uppermost course of siding on each of two adjacent walls, the walls meeting at a corner structure; installing a siding corner piece at the corner structure; installing a first and a second cornice molding strip on each of the walls over a top edge of the uppermost course of siding panels, the top edge being under an eave or soffit structure, each of the first and second cornice molding strips having a first end proximate the corner structure, there being a gap between the first ends and the corner structure and a gap between the first ends of the first and second cornice molding strips; providing a cornice molding corner cap having a top and a bottom, and an interior and an exterior, and capable of accommodating the first end of each of the cornice molding strips within the interior of the cornice molding cap; and, installing the corner cap over the ends of each of the cornice molding strips, thereby concealing the gaps between the ends of the cornice molding strips, wherein the providing step comprises molding of the corner cap using a process comprising injection molding.

In an embodiment of a siding installation having a corner structure, the siding installation comprises a first wall and a second wall, the walls meeting in a corner structure; a covering of siding material applied to each wall; a first cornice molding strip and a second cornice molding strip applied to each wall above an uppermost course of siding material, the cornice molding strips each having a first end proximate to the corner structure, the cornice molding strips having a gap between the first ends of each strip; a cornice molding cap installed over the first ends of each cornice molding strip, the cap covering the gap, the cap exhibiting a retention force of greater than about 5 lbs.

In an embodiment of a system for finishing a corner, the system comprises a cornice molding corner cap in combination with various other elements as disclosed and described herein.

The above and other features of the present invention will be better understood from the following detailed description of the preferred embodiments of the invention that is provided in connection with the accompanying drawings.

DETAILED DESCRIPTION

Figure 1:
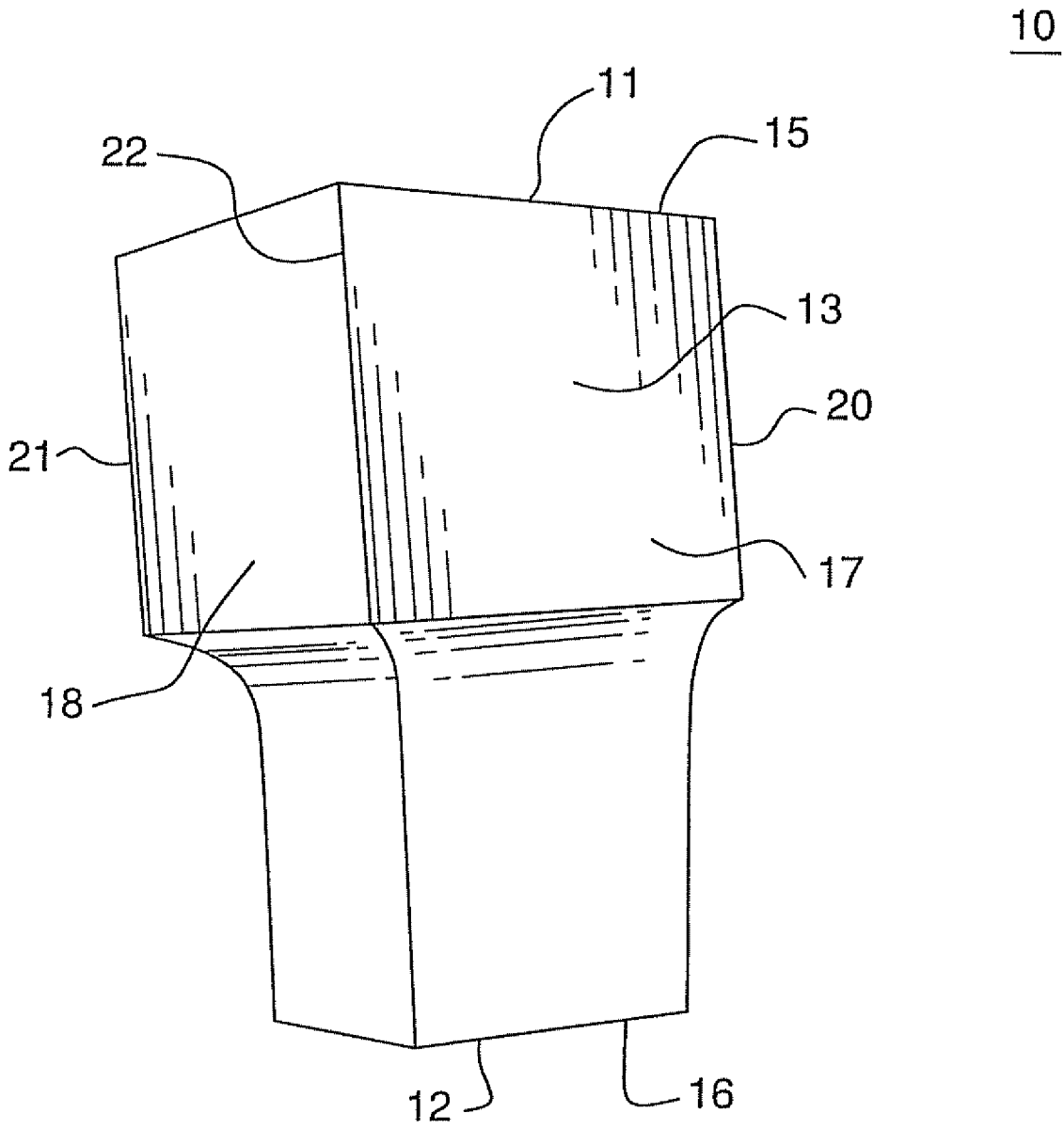
FIG. 1 is a front perspective view of the exterior of an exemplary cornice molding corner cap according to the present invention.
Figure 2:
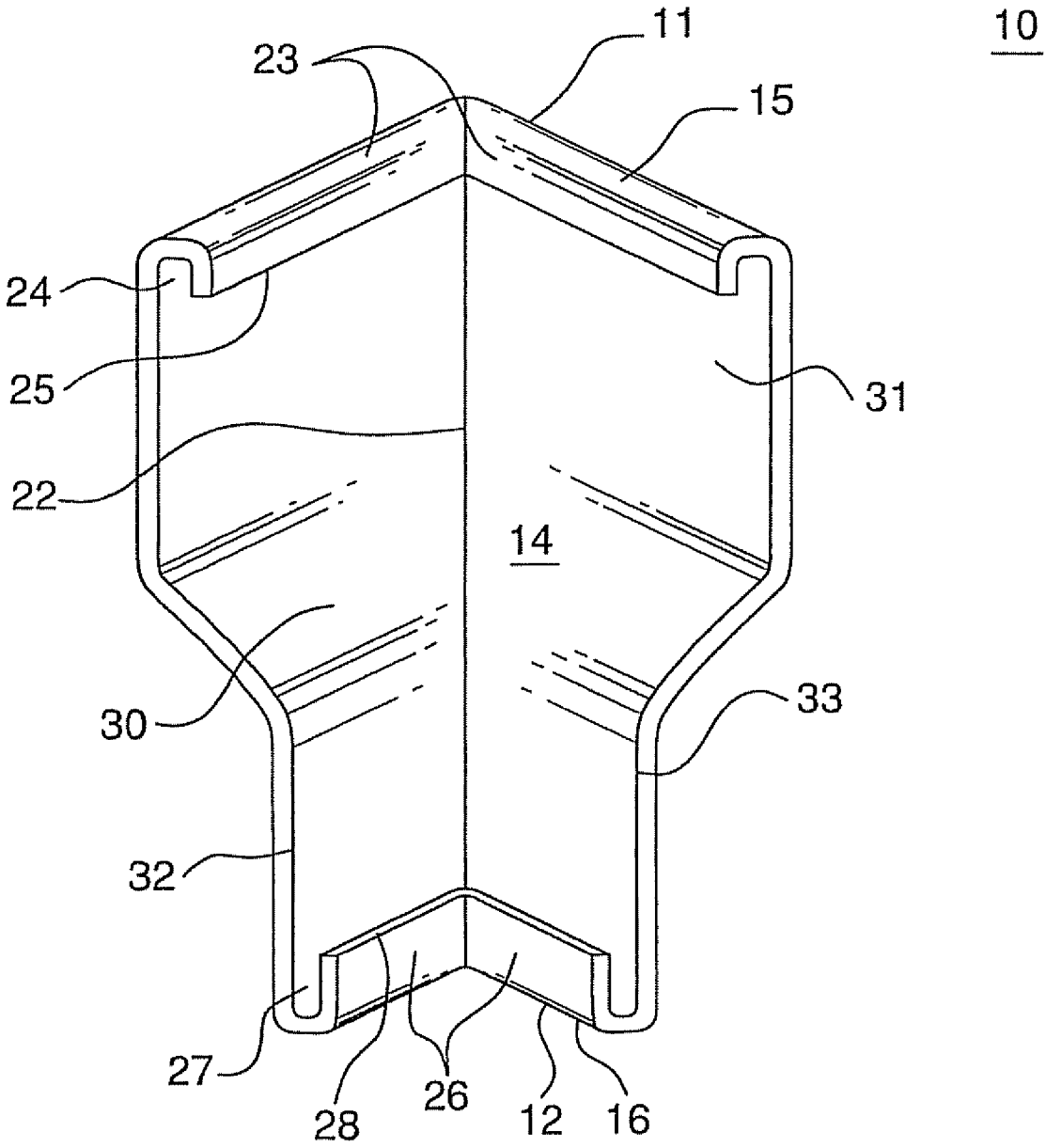
FIG. 2 is an inside perspective view of the interior of an exemplary cornice molding corner cap according to the present invention.
Figure 3:
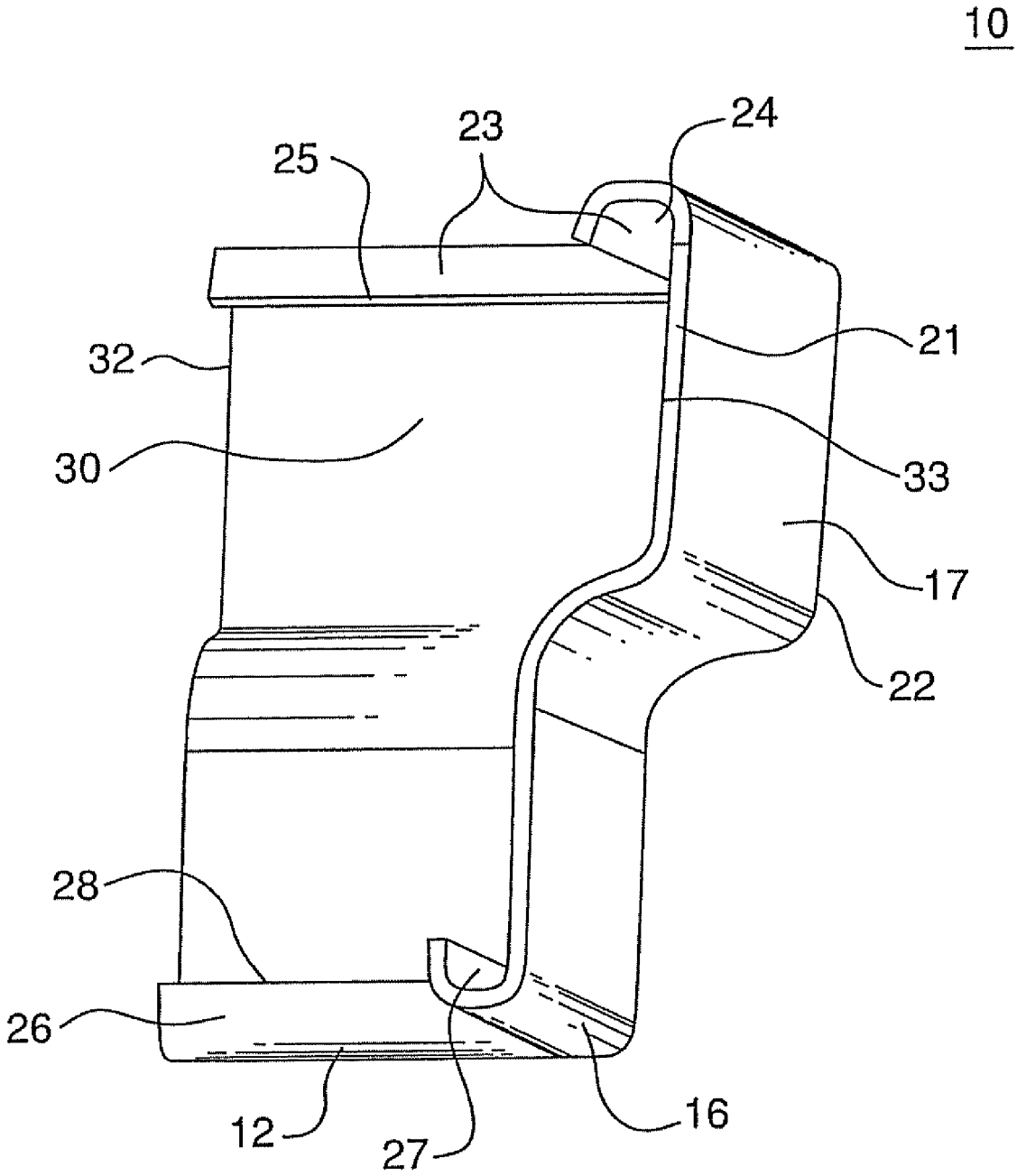
FIG. 3 is a perspective view of an exemplary cornice molding corner cap according to the present invention showing interior and exterior portions of the cap.
Figure 4B:
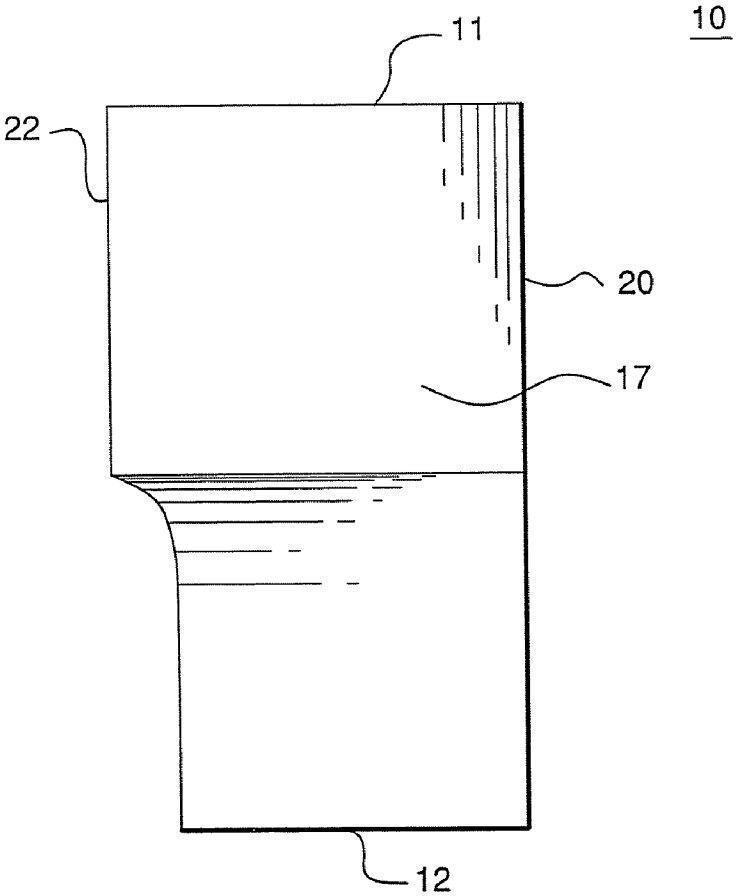
FIGS. 4*a* and 4*b* are each side elevation views of an exterior surface of the exemplary cornice molding corner cap of FIG. 1.
Figure 4A:
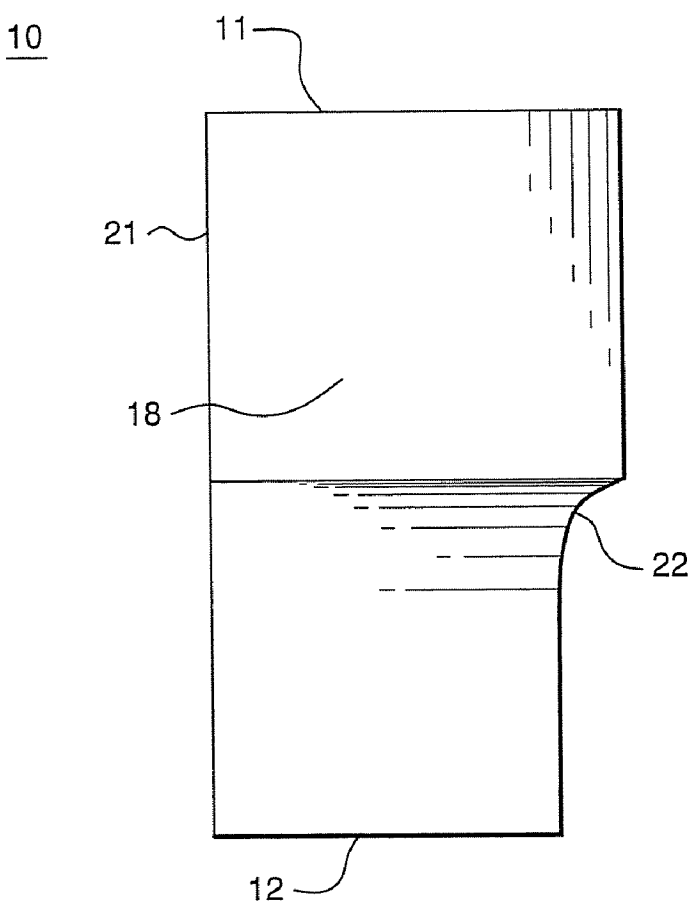
Figure 5B:
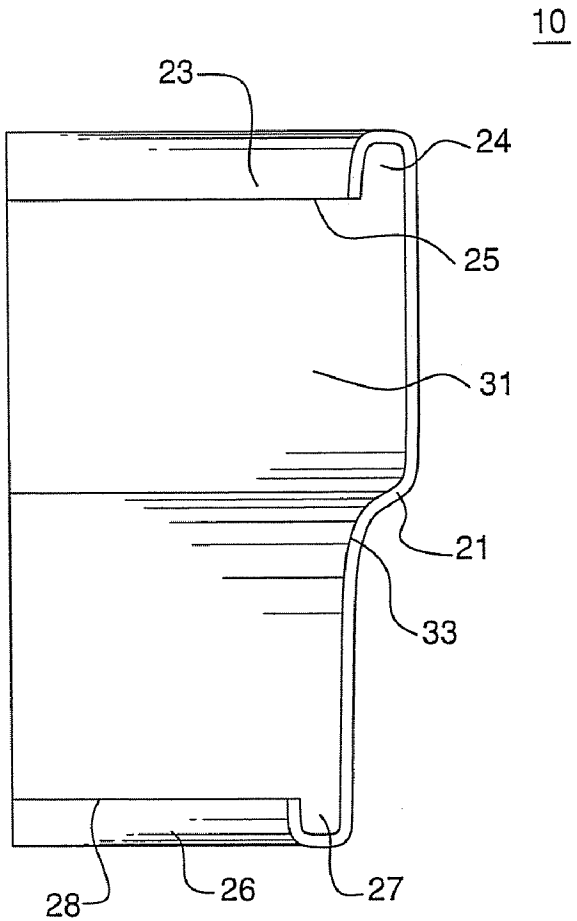
FIGS. 5*a* and 5*b* are each side elevation views of an interior surface of the exemplary cornice molding corner cap of FIG. 2.
Figure 5A:
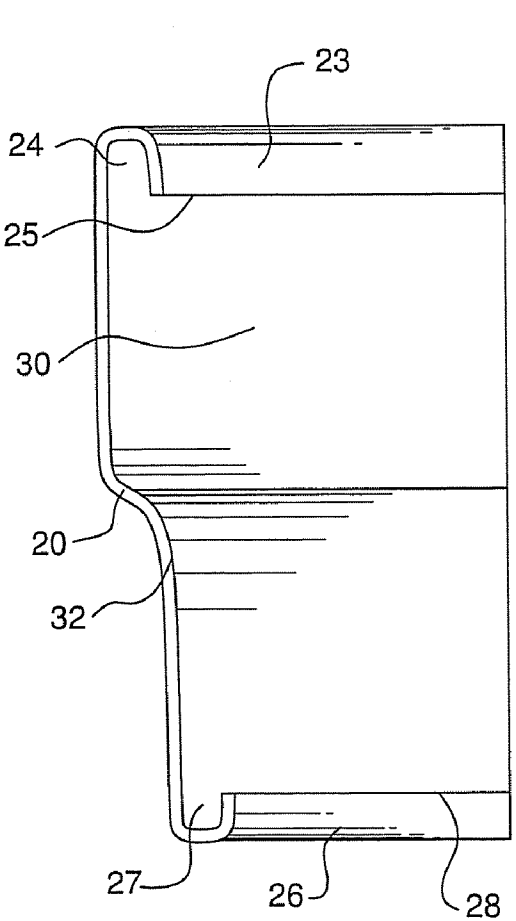

In embodiments, the present invention provides a preformed cornice molding corner cap for use in conjunction with a cornice molding trim strip as a part of an exterior siding installation at a corner structure provided by two mating walls. FIGS. 1 through 5 illustrate an exemplary embodiment of a cornice molding corner cap 10 for covering a cornice molding trim accessory strip at an "outside corner" of a structure. By "outside corner", it is meant that the corner piece has an exterior surface that extends along an angle comprising an obtuse angle to cover the cornice molding on an outwardly protruding or "outside" corner of a structure, or as opposed to the angle comprising an acute angle in which the surface is inwardly formed or on an "inside" corner of a structure. While FIGS. 1 through 5 portray a cap for an outside corner, cornice molding corner caps of appropriate geometry to cover cornice molding trim strips at an inwardly formed corner or inside corner with many of the features and advantages of the cap for an outside corner are also contemplated.

Referring more specifically now to FIGS. 1 through 5, the cornice molding corner cap 10 (alternatively, 430 in FIG. 14 or 1230 in FIG. 15*d*) is of unitary (i.e., one-piece) construction and with a body portion that has a top 11 and bottom 12, a decorative exterior 13 and an interior 14, an upper surface 15 and a lower surface 16, first 20 and second 21 lateral edges, and upper and lower retainer flanges 23 and 26. Upper and lower retainer flanges 23 and 26 each include therebetween a horizontal receiver channel 24 and 27 extending to an interior corner 22 each retainer flange having a lip 25 and 28. The cap includes first 17 and second 18 decorative exterior surfaces meeting at a corner 22 wherein the corner 22 extends to the interior of the body portion, the exterior surfaces being aesthetically of complementary shape and exterior finish to complement that of a cornice molding trim accessory strip 41 (alternatively 90, 103, 111, 320, 321, 420, 421, 1120, 1121, 1220 or 1221 referred to elsewhere herein). The corner cap 10 also includes first 30 and second 31 interior surfaces, the profiles of which 32 and 33 are physically of complementary shape to the outer surfaces of the cornice molding trim accessory strips 41 so as to receive slidably horizontal cornice molding trim accessory strips 41 within the receiver channels 24 and 27 that extend laterally horizontal and through opposite sides of the cap 10. In one presently preferred embodiment, the corner cap 10 has a dimension of about 2.6 inch between the upper and lower surfaces 15, 16 and a dimension of about 2 inches between each given lateral edge 20, 21 and the corner 22 measured while traveling horizontally across the upper surface 15 from the edge to the corner.

Figure 6:
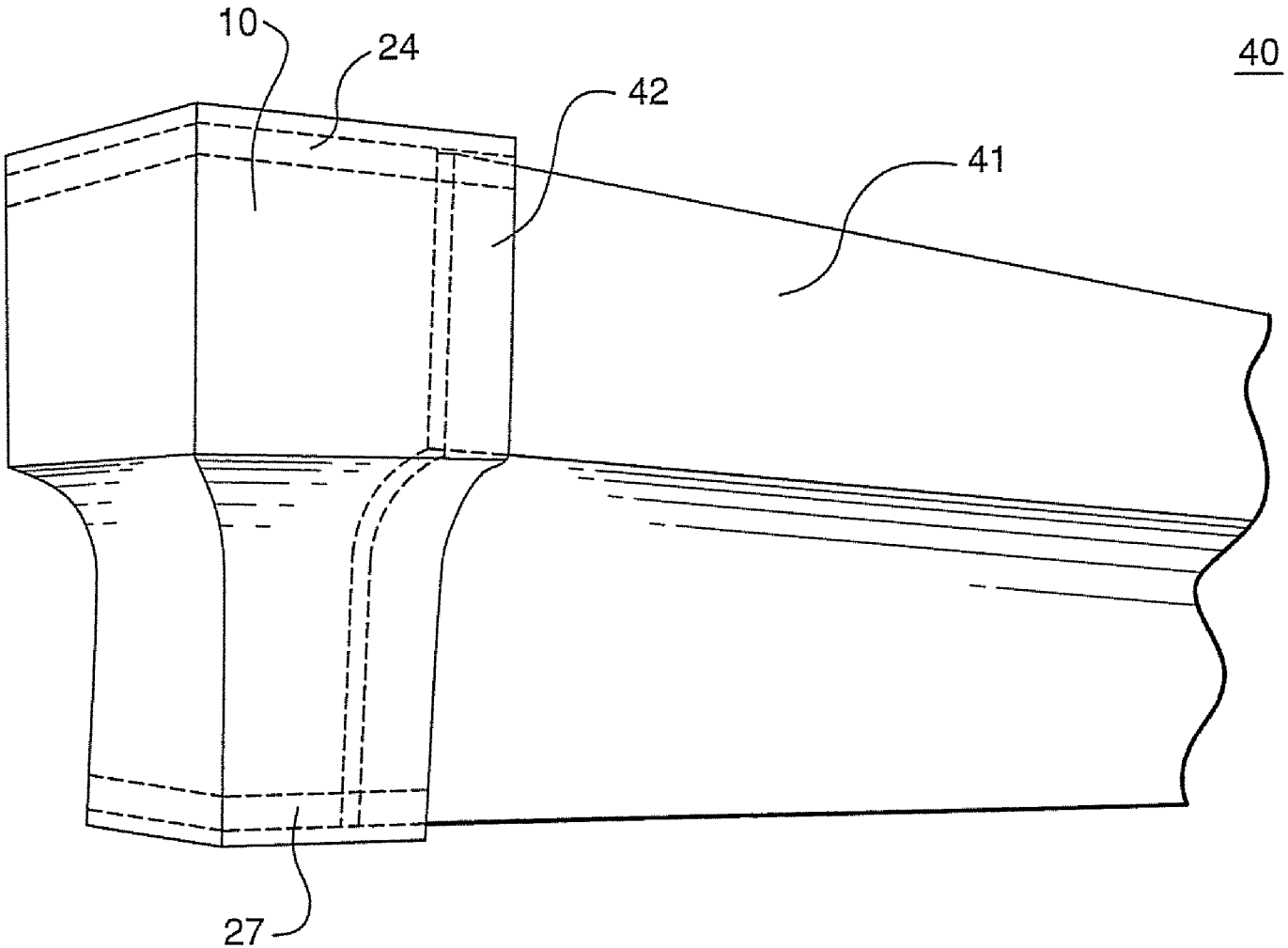
FIG. 6 is a perspective view of an assembly including an exemplary cornice molding corner cap and a cornice molding trim accessory strip.
Figure 7:
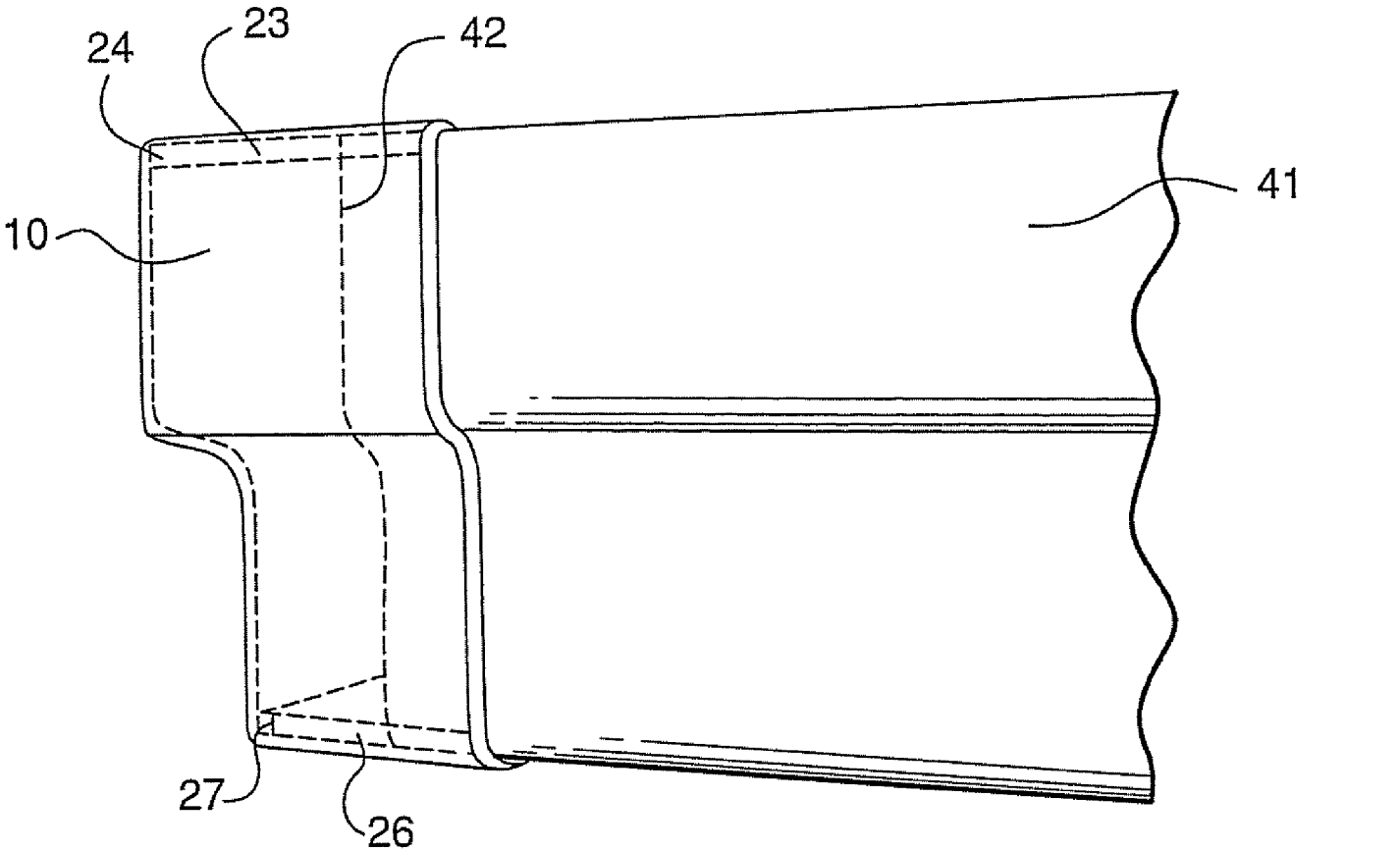
FIG. 7 is a perspective view of the assembly shown in FIG. 6.

FIG. 6 discloses an assembly 40 including a cornice molding corner cap 10 engaged with a cornice molding trim accessory strip 41. FIG. 7 shows the assembly 40 from a different angle. The molding accessory strip 41 is assembled without fasteners while engaged horizontally slidably between and within the upper 24 and lower 27 receiver channels that open toward each other and are within the upper 23 and lower 26 retaining flanges of the cap 10, the end 42 of the cornice molding accessory strip 41 and detailed portions of the cap within the interior 14 of the cap being shown in phantom. The molding accessory strip 41 is horizontally free without fasteners therethrough to move horizontally within and relative to the cap 10 due to environmental conditions, including but not limited to, thermal expansion and contraction, wind force and earth movement. The absence of fasteners avoids unsightly exposure thereof, as well as, avoids damage by hammer blows or screwdriver gouges, and permits ease of assembly by resiliently deflecting the flanges 23 and/or 26 of the cap 10 to widen the space between the upper and lower retaining flanges 23, 26, and snap fit and latch the cap 10 over the strips 41, by resilient return of the cap 10 to its original configuration prior to resilient deflection thereof. In this embodiment, the retainer flanges 23,26 have a dimension of about 0.25 inch from upper or lower surface 15,16 to flange lip 25,28. In some embodiments, preferably the upper and lower retainer flanges 23,26 are between about 0.1 and 0.4 inch in dimension, more preferably about 0.1 to 0.3 inches. This dimension provides a balance in adequate mechanically latching onto the cornice molding accessory strip 41 without interfering with the functionality of other parts of the molding accessory strip 41, such as, for example, a mounting flange 91 (alternatively 104 or 112 elsewhere herein) in use with a cornice molding trim accessory strip 41.

Figure 8:
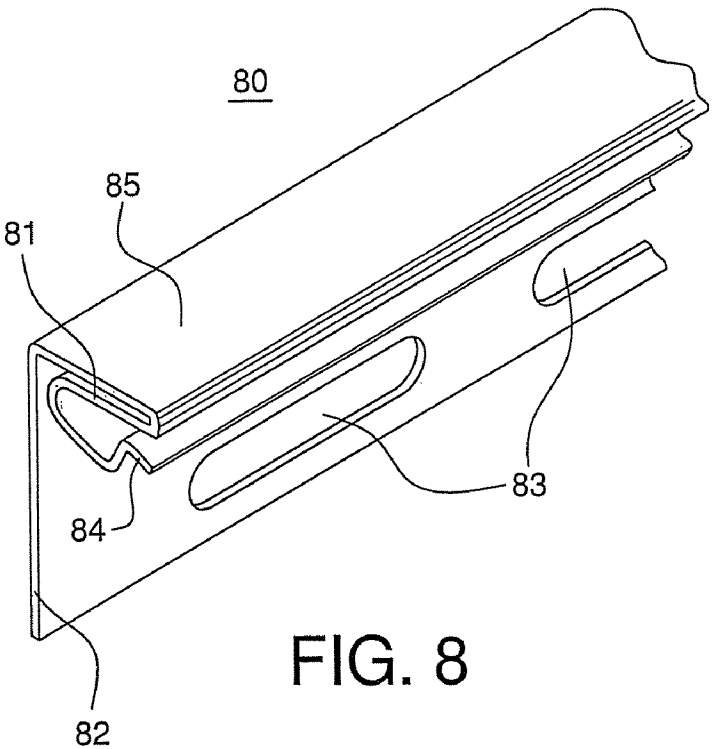
FIG. 8 is a perspective view of a cornice molding receiver strip.
Figure 10:
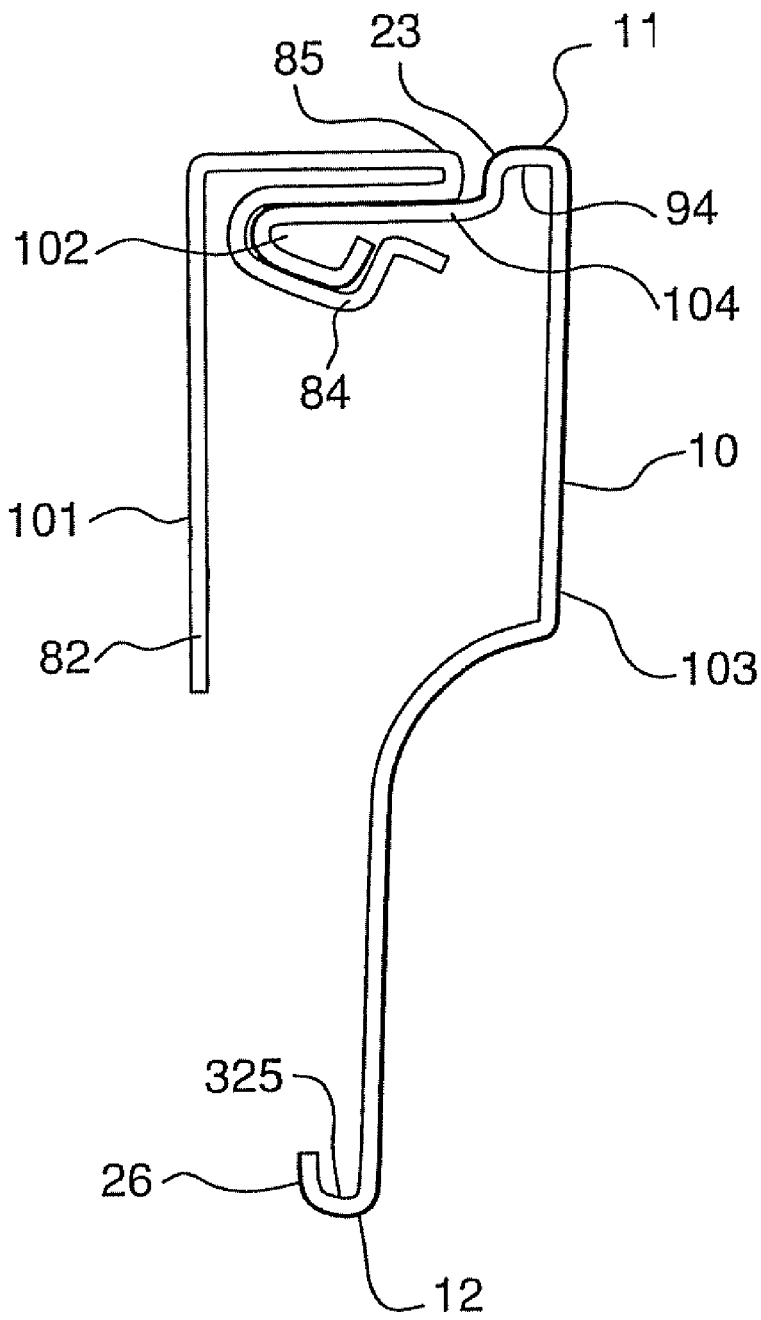
FIG. 10 is an end elevation view of a cornice molding trim accessory strip as in FIG. 9 engaged in a cornice molding receiver strip as in FIG. 8.

FIG. 8 shows a section of cornice receiver strip 80 (alternatively 101, 910 or 1010 elsewhere herein) having a receiver channel 81 (alternatively 114, 102, 214, 314, 911 or 1011 elsewhere herein) and a fastening flange 82. The receiver channel 81 has a retainer flange 84 for engaging a mounting flange 91, 104 or 112 from an accessory strip, such as, a cornice molding trim accessory strip 103, alternatively 41, 90, 111, 320, 321, 420, 421, 1120, 1121, 1220 or 1221, that is to be mounted to a surface by using the retainer flange 84 of the receiver strip 80. In FIG. 10, the mounting flange 104, alternatively 9 or 112, is inserted into the receiver channel 81 by resiliently biasing the retainer flange 84 to move and widen the narrow entrance to the receiver channel 81, followed by return movement of the retainer flange 84 due to stored spring energy to partially envelop the mounting flange 104 and interlock in place the accessory strip 103. A ledge 85 is formed by doubling back the strip 80 at the entrance to the receiver channel 81. The fastening flange 82 is equipped with fastening holes 83 to enable attachment to a wall by mechanical fasteners such as nails, screws, staples, rivets, snaps, hook and loop fasteners, or the like. Adhesives could also be used to attach a receiver strip 80 to a wall. The fastening holes 83 are preferably elongated horizontally as shown in FIG. 8 to accommodate thermal expansion and contraction of the strip and ease fastener placement during installation.

Figure 9:
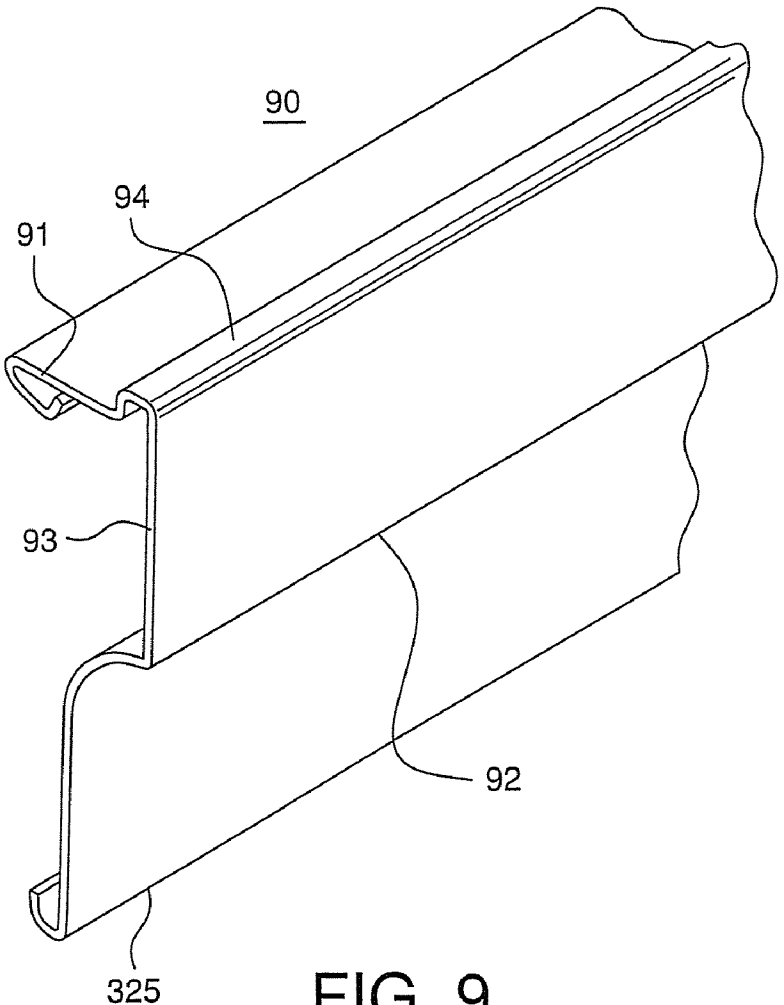
FIG. 9 is a perspective view of a cornice molding trim accessory strip.

FIG. 9 shows a cornice molding trim accessory strip 90 having an exterior surface 92 and an exterior surface profile 93. The exterior surface 92 and the exterior profile 93 provide aesthetic benefit to a siding installation, for example, in the transition region between the wall and a soffit or eave 108 in FIG. 15*d*. The cornice molding trim accessory strip 90 also has a mounting flange 91 (alternatively 104 or 112 referred to elsewhere herein) for attachment to a wall or other surface using a molding receiver strip 80 having a receiver channel 81 and a retainer flange 84. The cornice molding trim accessory strip 90 has a projecting upper lip 94 defining an upper part of the profile 93 and an depending bottom 325 upturned at the end and providing a covering skirt or covering flange to cover and conceal an uppermost course of siding or siding panel 204, 205, 904, 1005, 1105, 1106, 1205 or 1206 and an uppermost part of a siding corner piece 208, 408, 1007, 1107 or 1207. The upper lip 94 may abut a soffit 1208, FIG. 15*d*, below and against which the molding strip is installed, and/or may also provide a geometric feature to aid in the attachment of other items or accessories such as, for example, the cornice molding corner cap 10 of the present invention, to the cornice molding strip.

FIG. 10 depicts an assembly 100 in which a cornice molding trim accessory strip 103 is attached to a cornice receiver strip 101. The receiver channel 102 of 101 receives the mounting flange 104 of 103 in a friction fit to hold the cornice molding trim accessory strip 103 in place. The retainer flange 84 biases as a resiliently deflected cantilever beam against the mounting flange 104. Subsequently, the assembly 100 is assembled with a cornice molding corner cap 10, by snap fitting the cap 10 over the two cornice molding trim accessory strips 103 adjacent the corner. The upper retaining flange 23 is hooked onto and conforms tightly to the raised upper lip 94 of each accessory strip 103 and is wedged between the upper lip 94 and the doubled back flange 85 above the entrance to the receiver channel 102. The corner cap 10 is present to cover a portion of the raised upper lip 94 without entering the receiver channel 102 to interfere with or distort the cornice receiver strip 101 or the F-channel cornice receiver strip 113, FIG. 11, whichever is used. Where the cap 10 is not present, the lip 94 is biased against the flange 85 by the inherent bias and friction fit of the mounting flange 104 and the retainer flange 84. Thus the thickness of the upper retaining flange 23 on the corner cap 10 has a thickness that is readily covered by the lip 94 without opening the lip 94 to form a gap behind the lip 94. The flange 26 at the bottom 12 of the cap 10 snap fits over the bottom 325 or 327 of the corresponding cornice molding trim accessory strip 320 or 321 and wedges between the bottom 325 or 327 and an uppermost course of siding panel described hereafter with reference to 204, 205, 904, 1005, 1006, 1205 or 1206 and between the bottom 325 or 327 and an uppermost course of siding corner piece described hereafter with reference to 208, 408, 1007, 1107 or 1207. In the absence of the corner cap 10 the bottom 325 or 327 is turned inward with a rounded chamfer to emulate a chamfered trim board when viewed. The bottom 325 or 327 is biased by inherent cantilever beam resiliency in the strip 320 or 321 to engage the uppermost courses of siding panel and siding corner piece, and the bottom 325 or 327 is flexible to conform against surface dimension irregularities without causing a visibly noticeable gap. Accordingly, the thickness of the lower retaining flange 26 is sufficiently thin for being readily covered and conformed against by the bottom 325 or 327 without opening the bottom 325 or 327 to form a visibly noticeable gap behind the bottom 325 or 327.

Figure 11:
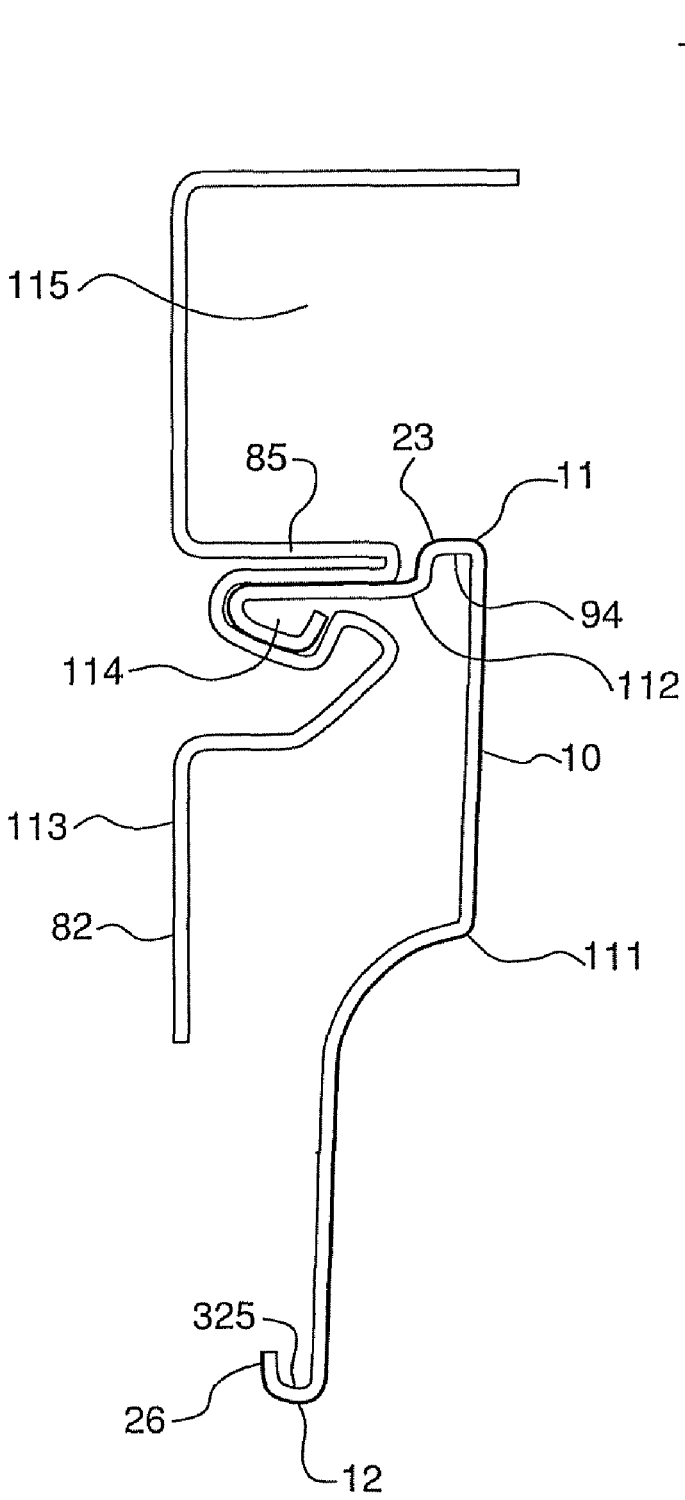
FIG. 11 is an end elevation view of a cornice molding trim accessory strip engaged in an F-channel cornice receiver strip.

FIG. 11 depicts an assembly 110 in which a cornice molding trim accessory strip 111 is attached to an F-channel cornice receiver strip 113 (alternatively 211, 212, 311 or 312 elsewhere herein). The F-channel strip is equipped with a soffit receiver pocket 115 that serves to receive a soffit panel of a soffit 1208, FIG. 15*d*, above the cornice molding trimmed siding installation. The receiver channel 114 of the F-channel cornice receiver strip 113 receives the mounting flange 112 in a friction fit to interlock and hold the cornice molding trim accessory strip 111 in place. Except for having the F-channel receiver strip 113 the F-channel cornice receiver strip 113 has the same features as the cornice receiver strip 80 (alternatively 101, 910 and 110 elsewhere herein). The cap 10 is subsequently assembled to the assembly 110 similarly as described with reference to FIG. 10 wherein the cap 10 is assembled to the assembly 100. The features of the cap 10 in the assembly 100 similarly apply to the assembly 110.

Figure 12:
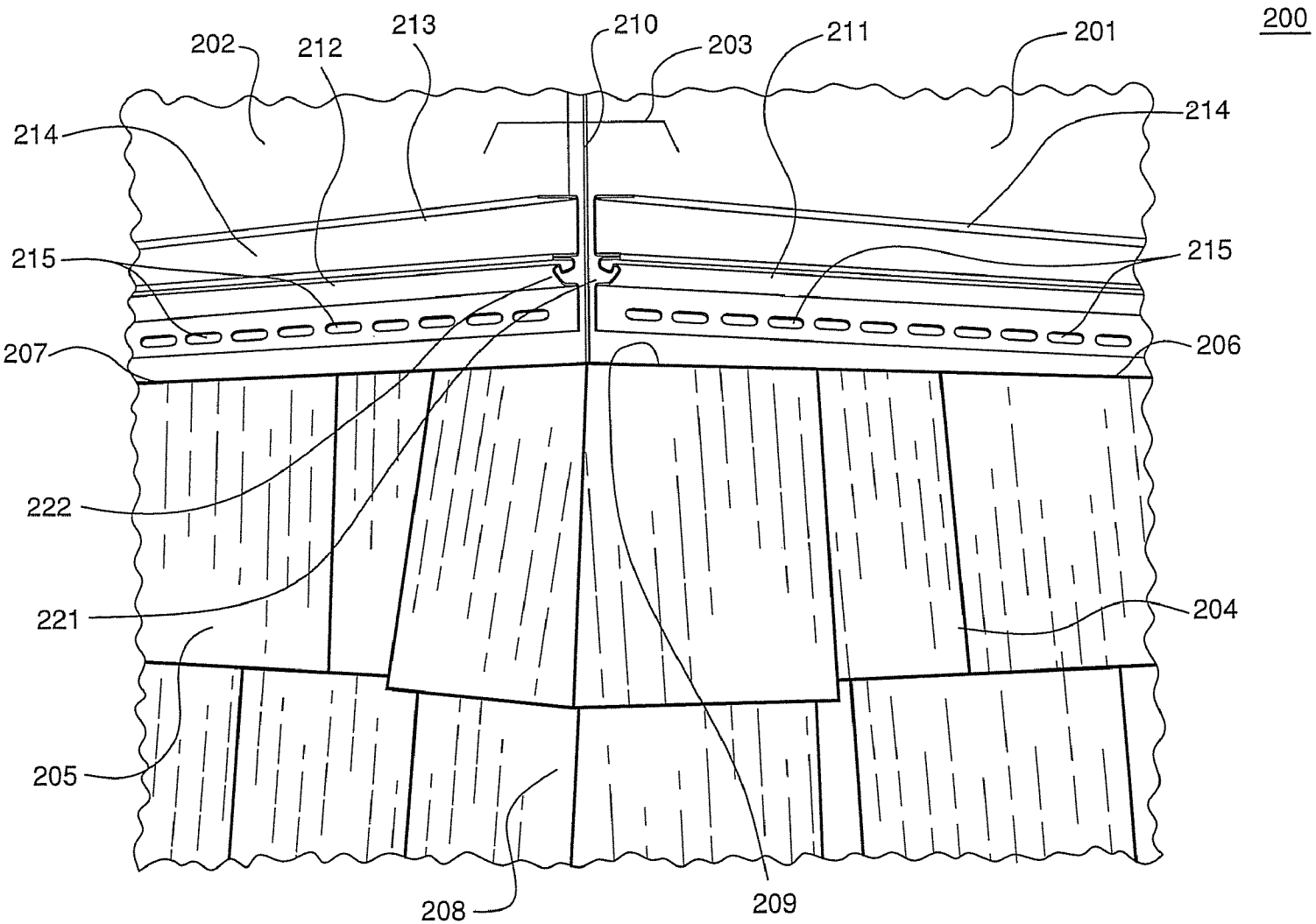
FIG. 12 is a perspective view of a wall corner having a siding corner piece and F-channel cornice receiver strips attached thereon.
Figure 13:
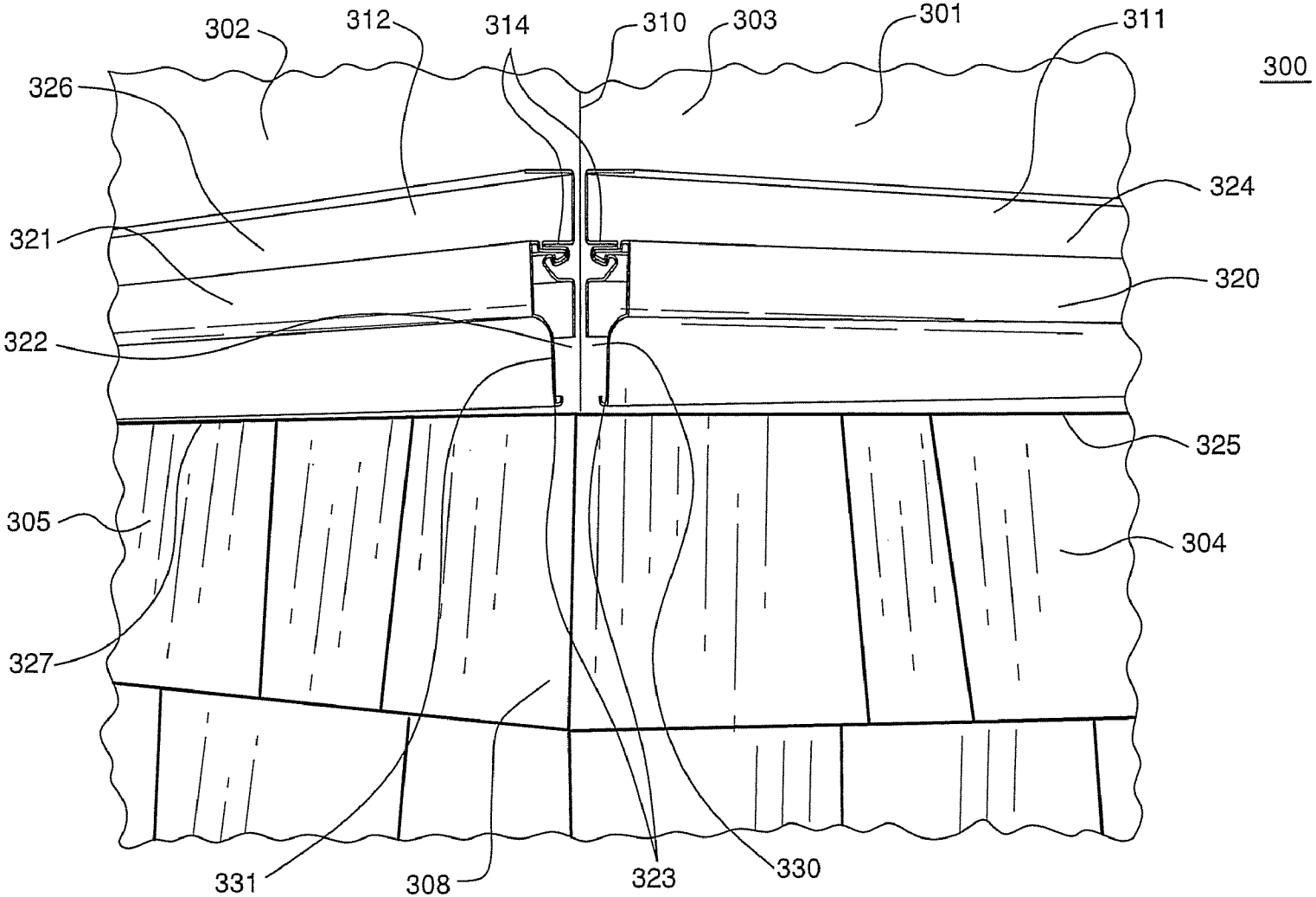
FIG. 13 is a perspective view of cornice molding trim accessory strips being wall mounted and attached to the F-channel cornice receiver strips of FIG. 13.
Figure 14:
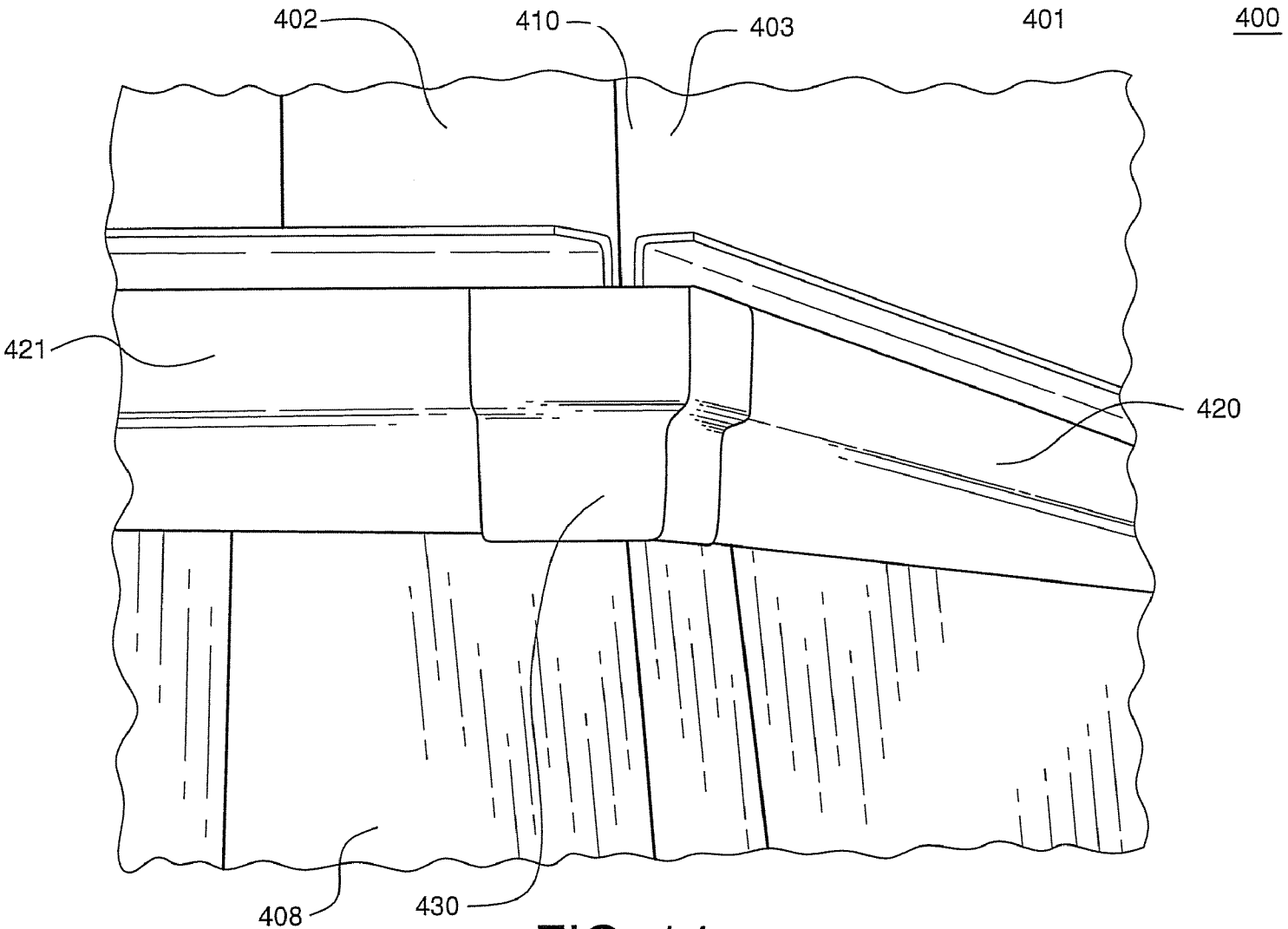
FIG. 14 is a perspective view of an exemplary cornice molding corner cap according to the present invention attached to the F-channel cornice molding trim accessory strips of FIG. 13.

FIGS. 12 to 14 show there are sequential steps in the installation and placement of a cornice molding corner cap of the present invention on a wall. In FIG. 12, an assembly 200 is presented including siding panels, siding corner pieces and cornice molding retainer strips. A first wall 201 and a second wall 202 meet at a corner structure 203 having a corner structure edge 210. An uppermost course of siding panels 204 on the first wall 201 and an uppermost course of siding panels 205 on the second wall 202 are shown in phantom under a siding corner piece 208. The first uppermost course 204 has an upper edge 206 and the second uppermost course 205 has an upper edge 207. The ends of the phantom siding panels 204,205 are covered by siding corner piece 208, the corner piece having an upper edge 209. First and second cornice receiver strips 211 and 212, each having a soffit receiver pocket 213 and a cornice receiver channel 214, are attached to the first and second walls 201,202 by fasteners 215. The cornice receiver strip is preferably spaced above the upper edge of the siding panels 206,207 by a gap of about 0.25 inch. The ends of the cornice molding receiver strips 221, 222 are spaced slightly back from the edge 210 of the corner structure 203. This spacing allows for dimensional changes that may occur in the strips in use. A preferred spacing of the ends of the receiver strips 221,222 from the edge 210 is about 0.25 inch. Spacing of the ends from the edge could be greater, however, if desired, as long as there is a sufficient length of receiver strip mounted on the wall to retain a subsequently applied molding strip in place.

In FIG. 13, an assembly 300 is presented similarly to assembly 200 of FIG. 12, but with the addition of having had cornice molding strips 320,321 installed into cornice receiver channels 314 to mount the cornice molding accessory strips to the walls 301,302. The first wall 301 and the second wall 302 meet at a corner structure 303 having a corner structure edge 310. An uppermost course of siding panels 304 on the first wall 301 and an uppermost course of siding panels 305 on the second wall 302 are shown in phantom. The first uppermost course 304 has an upper edge and the second uppermost course 305 has an upper edge, the upper edges being not shown as they are covered by the cornice molding strip. The ends of the phantom siding panels 304,305 are covered by the uppermost course of siding corner piece 308, the corner piece having an upper edge that is also concealed by the cornice molding strip. First and second cornice receivers 311 and 312, each having a cornice receiver channel 314, are attached to the first and second walls 301,302 by fasteners which are not shown, as they, too, are concealed by the cornice molding accessory trim strip. The cornice molding strips 320,321 are installed by being snapped into the receiver channels 314 of the receiver strips 311,312. The cornice molding accessory strips each have a top 324,326, a bottom 325,327 and ends 330,331, respectively. The ends of the cornice molding receiver strips 314 and the ends 330,331 of the cornice molding accessory strips 320,321 are spaced slightly back from the edge 310 of the corner structure 303. The ends of the two molding strips 330,331 have a gap 322 between them and the molding strips have a gap 323 between each end 330,331 and the edge 310 of the corner structure 303. This spacing allows for dimensional changes that may occur in the strips in use. A preferred spacing of the ends of the receiver strips 311, 312 and the molding strips 320,321 from the edge 310 is about 0.25 inch. Spacing of the ends of the molding strips 320,321 from the edge 310 could be greater, however, if desired, as long as there is a sufficient length of cornice molding strip mounted on the wall at the corner to enter the receiver channels to be engaged by the retainer flanges 23, 26 of a subsequently applied cornice molding corner cap 10 and to hold the cap 10 in place in place.

FIG. 14 shows assembly 400, including first and second walls 401,402 that mate in a corner structure 403 having an edge 410. First and second cornice molding trim accessory strips 420,421 are mounted on the walls covering an upper edge of a siding corner piece 408. A cornice molding corner cap 430 of the present invention is installed at the corner covering the ends of the cornice molding strips 420,421 and the upper edge of the siding corner piece 408. The cornice cap 430 is installed by hooking the top of the cornice cap 430 over the end of the cornice molding strips 420,421 and pivoting the lower flanges 26 to engage and bias against the strips 420,421 and snapping the bottom 12 into place. Alternatively, the cap 430 is installed by sliding a first receiver channel of the cap 430 over the end of the first of the cornice molding strips 420 or 421 until the second receiver channel of the cap 430 is aligned with the second of cornice molding strips 420 or 421. If the ends of the cornice molding strips 420 or 421, or both can be pulled manually out from the wall slightly without causing permanent bending thereof, the end of the second of the cornice molding strips 420 or 421 can be aligned with the second receiver channel of the cap 430 and then inserted into the second receiver channel of the cap 430. Alternatively, if the cornice molding strips 420 or 421 can not be pulled manually out from the wall without causing permanent bending thereof, the second cornice molding strip 420 or 430 is inserted by manually urging the interior of the cap 430 against the surface of the second of the cornice molding strips 420 or 421, followed by inserting the second cornice molding strip 420 or 421 into the cap 430 by biasing apart the upper and lower flanges 23, 26 against the second cornice molding strip 420 or 421 and snap fitting the cap 430 onto and over the second cornice molding strip 420 or 421. Further details of the cap 430 will be described with reference to the cap 1230 in FIG. 15*d*.

Figure 15A:
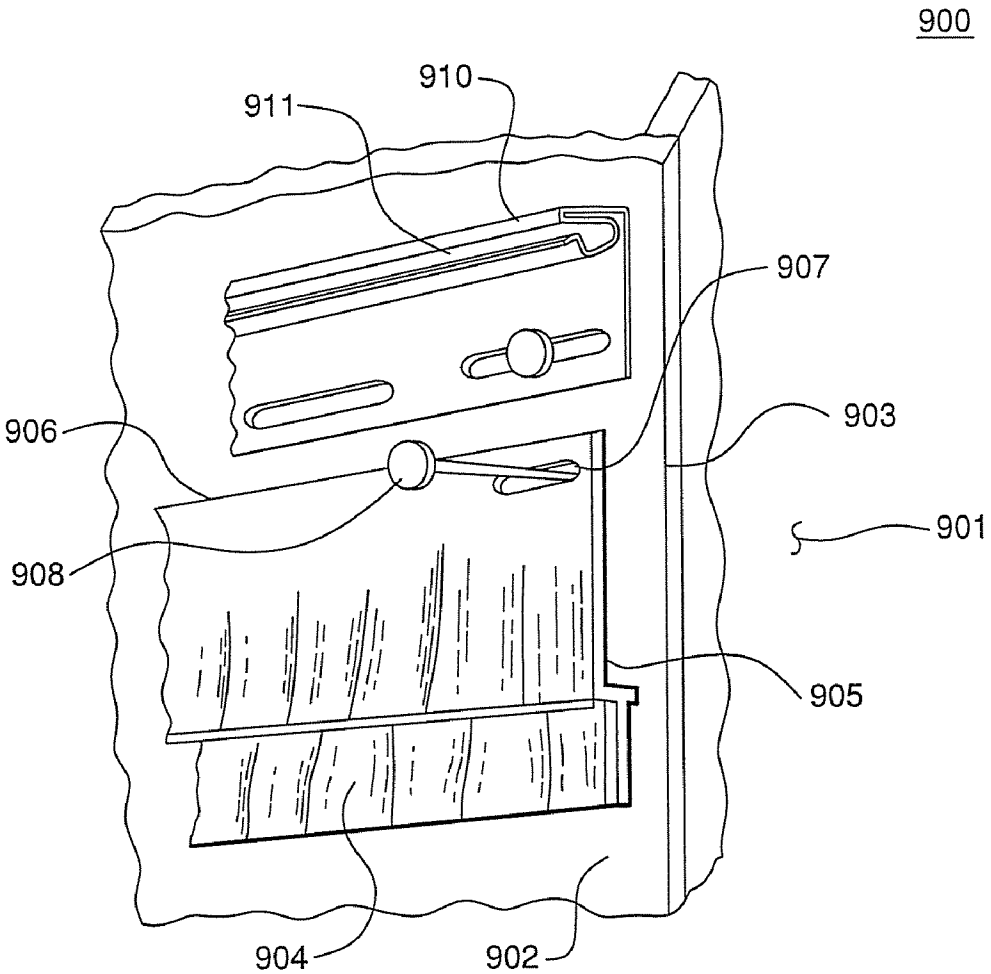
FIG. 15*a* is a perspective view of a wall corner having an exemplary uppermost course of siding panel mounted thereon, and an exemplary cornice receiver strip mounted thereon.

Another assembly 900 is shown in FIG. 15*a*, in which a first wall 901 and a second 902 wall meet at a corner structure edge 903. An uppermost course of siding panel 904, the panel having an end edge 905 and a top edge 906, is attached to the second wall 902 by a fastener 908 through fastener hole 907. A cornice receiver 910 having a receiver channel 911 is attached to the wall 902 above the siding panel 904. In finishing the upper edge 906 of uppermost course of siding 904, the upper edge is trimmed for appropriate fit on the wall below the soffit area. A nail slot punch can be used to punch nail slots about 0.25 inch from the trimmed edge 905 of the siding panel so as to enable fastening of the panel to the wall in the case where the height of the top of the wall does not coincide with an integral number of courses of siding panel. Such nail slots are necessary for fastening when a preformed nail hem has been trimmed from the upper edge 906 of the panel 904. The end edge 905 of the panel will later be concealed under a siding corner piece in completing the installation. The cornice receiver 910 is preferably spaced about 0.25 inch above the top edge 906 of the uppermost course of siding panels 904.

Figure 15B:
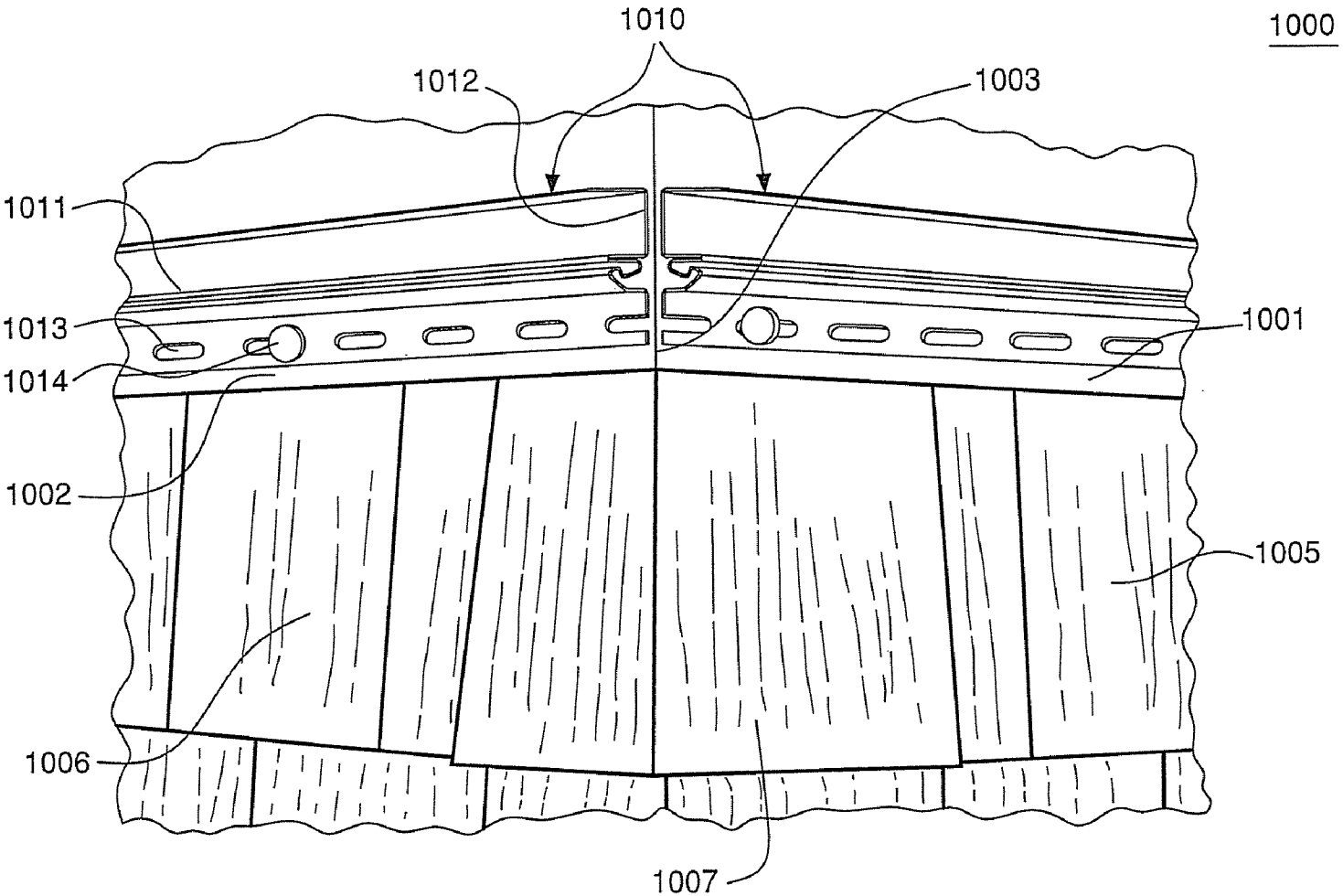
FIG. 15*b* is a perspective view of a wall corner having F-channel cornice receiver strips mounted thereon, and siding panels and a siding corner piece mounted thereon.

In FIG. 15*b*, the next step of finishing of a siding corner installation is shown as assembly 1000. First and second walls 1001,1002 meet at a corner structure edge 1003. Uppermost course of siding 1005 is attached to the first wall 1001 and uppermost course of siding 1006 is attached to the second wall 1002. An uppermost siding corner piece 1007 is mounted on the corner, concealing the ends of the siding panels 1005, 1006. Cornice receiver strips 1010 having receiver channels 1011 are mounted on the wall at a position above the top edge of the uppermost courses of siding such that the ends 1012 of the cornice receiver strips are recessed or spaced slightly away from the corner structure edge 1003. The receiver strips are attached by fasteners 1014 through fastener holes 1013. Spacing of the receiver strips is preferably about 0.25 inch above the top edge of the siding panels. The spacing of the receiver strip ends 1012 away from the corner edge 1003 is preferably also about 0.25.

Figure 15C:
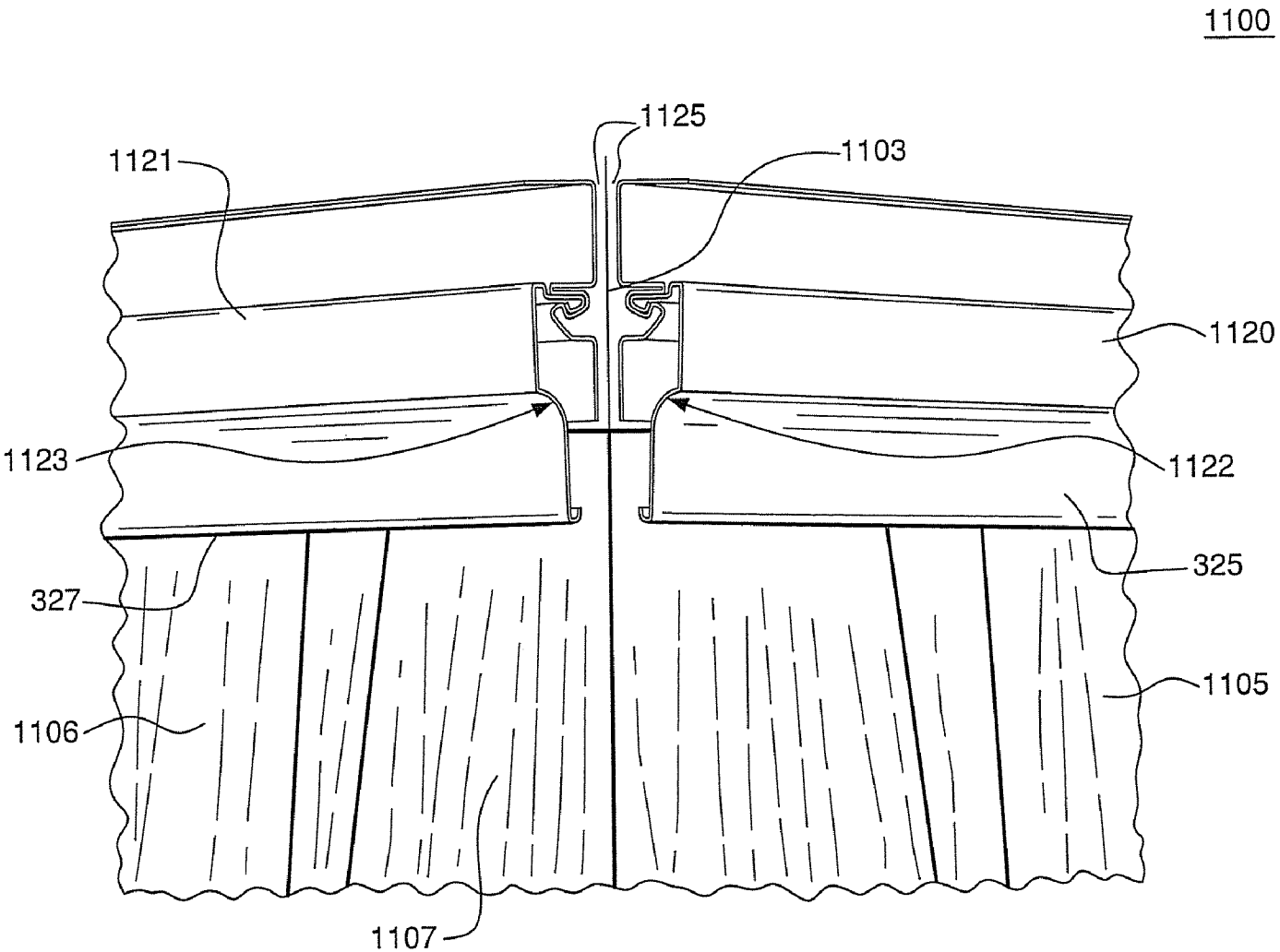
FIG. 15*c* is a perspective view of the wall corner of FIG. 15*b*, wherein cornice molding trim accessory strips have been mounted to the walls meeting at the outside corner by F-channel cornice molding receiver strips.

In FIG. 15*c*, the resulting assembly 1100 of a further step in the finishing of a corner is presented. Adjacent a corner structure edge 1103 are provided an uppermost siding course 1105 on a first wall and an uppermost course of siding 1106 on a second wall, each course having a terminal end proximate to the corner structure edge, and having the terminal ends covered and concealed by an uppermost siding corner piece 1107. The cornice receiver strips of FIG. 15*b* have been covered by cornice molding strips 1120,1121, each molding strip having an end 1122,1123 near the corner structure edge 1103. The cornice molding strips are retained without fasteners and horizontally slidable in receiver channels of receiver strips analogously to the representation of FIG. 13 into which the mounting flange of the molding strips were snapped. There is a gap 1125 between each cornice molding strip end and the corner structure edge. The gap allows for horizontal thermal expansion and contraction of the cornice molding strips during use without the possibility of contact or interaction of the ends with each other and without restraint by fasteners therethrough, either of which could result in distortion or buckling of the molding strips. The gap also allows for ease and speed of installation, as the length of the molding strip near the edge of the wall does not need to be as precise as in the case of the forming of a fine structure such as a mitered corner of the molding strip itself. The gap is preferably on the order of about 0.25 inch, but could vary to the extent that once a cornice molding corner cap (not shown in 15*c*) is installed, a sufficient portion of each of the molding strip ends 1122,1123 is contained within the cap to hold the cap in place.

Figure 15D:
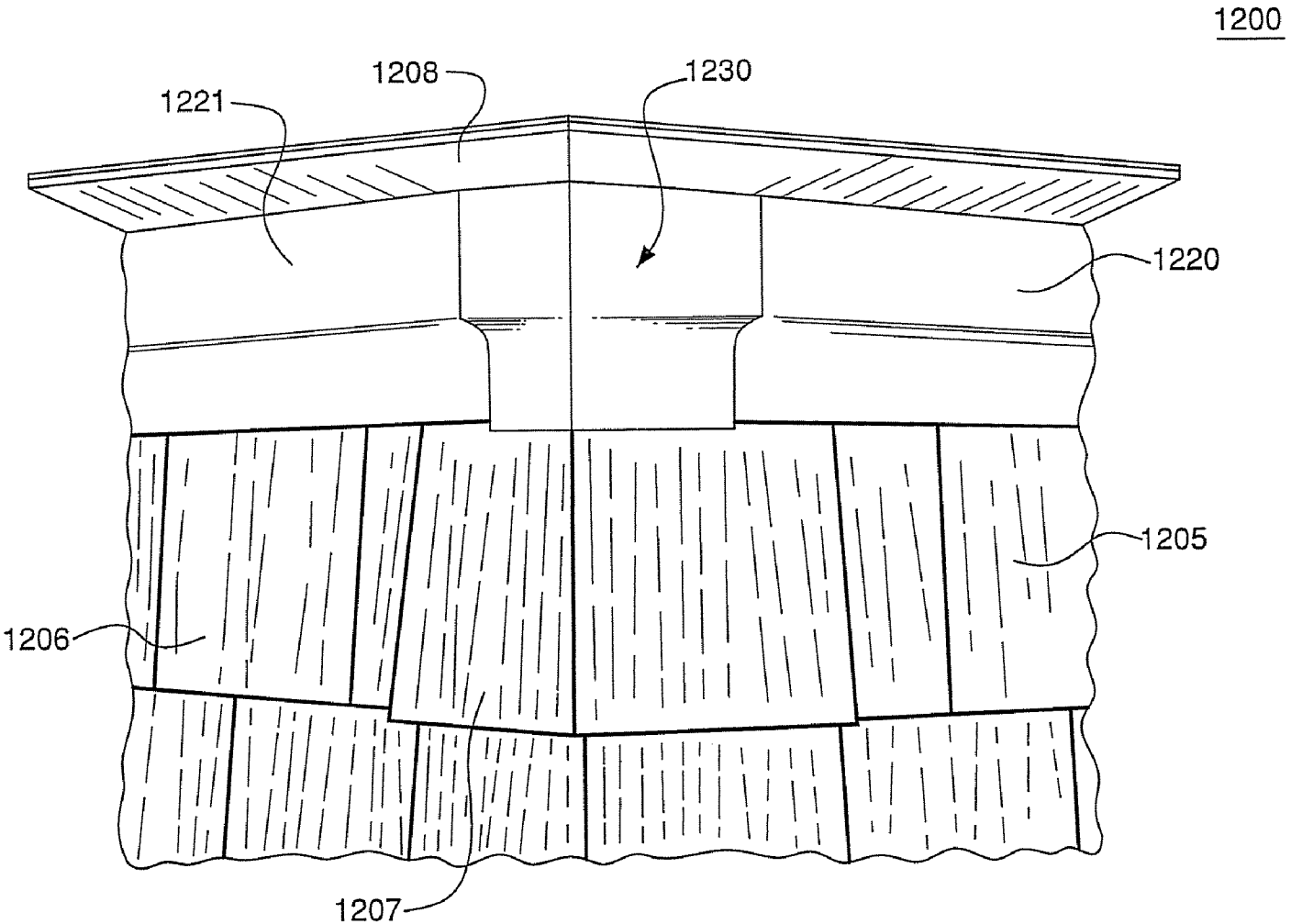
FIG. 15*d* is a perspective view of an exemplary cornice molding corner cap according to the present invention attached to the cornice molding trim accessory strips of FIG. 15*c*.

In the assembly 1200 of FIG. 15*d*, the cornice molding corner cap 1230 is in place at a wall corner covering the gap between the ends of two cornice molding strips 1220,1221 mounted on walls clad with uppermost courses of siding

1205,1206 and a siding corner piece 1207. The molding strips 1220, 1221 and corner cap 1230 cover the uppermost edges of the siding panels 1205, 1206 and siding corner piece 1207 to create a finished wall corner. The cornice molding corner cap 1230 has an aesthetic aspect complementary to the cornice molding strips 1220, 1221. Further, the cap 1230 is installed as described with reference to the cap 430 in FIG. 14, such that the body portion of the cap 1230 is in front of and concealing respective ends 1122, 1123 of the cornice molding trim accessory strips 1220, 1221, while the respective ends 1122, 1123 are spaced apart from each other at the interior corner 22 of the body portion of the cap 1230 to allow for said expansion and contraction without engaging each other and without abutting the interior corner 22. Further, in the cap 1230 the upper retainer flanges 23 are horizontally aligned with each other, and the lower retainer flanges 26 are horizontally aligned with each other, such that they interlock with and hold the cornice molding trim accessory strips 1220, 1221 in horizontal alignment with each other and in horizontal alignment against a soffit 1208, FIG. 15*d*, over the passage of time to retain an aesthetic appearance, as well as a barrier to weather conditions. Further, the horizontally aligned flanges 23 and 26 will bias the ends of the molding trim accessory strips 1220, 1221 into horizontal alignment with each other when they have been installed slightly out of alignment. FIG. 15*d* discloses an exemplary soffit 1208 against which the cap 1230 and cornice molding trim accessory strips 1220, 1221 abut. The soffit receiver pocket 115 or 213 of an F-channel cornice receiver strip 113, 211, 212, 311 or 312 receives a rear edge (not shown) of the soffit 1208. The cap 1230 has a top 11 of sufficiently thin thickness to conform closely to the surface of the lip 94 such that the top 11 wedges between the lip 94 and the soffit 1208 without opening a visibly noticeable gap between the lip 94 and the soffit 1208.

The cornice molding corner caps 10, 430, 1230 of the present invention, in addition to providing aesthetic beauty to an architectural structure, have further functional attributes. The cap is easy to handle and easy to install as a substitute for constructing a finished corner on horizontal ends of the cornice molding made by assembling the cornice receiver strips and the cornice molding trim accessory strips. Further, the cap avoids the need for fasteners at the corner, and solves a problem of how to allow for thermal expansion and contraction of a cornice molding at a corner thereof. The cap, because it is preformed, simplifies the process of finishing corner trim applications. The level of precision of trimming and carpentry work required at the end of a trim strip at a building corner is reduced as the ends of the trim pieces are covered by the corner cap. Caps of the invention can be easily hooked or snapped over the terminal ends of molding strips at the corner of a structure to attain a finished look.

The cap also serves the purpose of closing the cladding on a building structure. The gap at the end of trim strips is effectively covered. This covering prevents or reduces entry of insects and infiltration of water through the gap in the trim strip ends at the edge of a wall having an otherwise more open structure. The receiver channels in the cap allow the cornice molding strips to move freely to expand and contract as necessary with environmental changes such as thermal fluctuations or changes in humidity.

The cap also should resist displacement or dislodgement by forces to which it may be exposed. In windy areas, the cap should remain in place. The cap should not be easily removed or disconnected from the structure unintentionally by impacts.

To test the resistance to displacement, a cornice cap of the invention was mounted on cornice molding strips attached to a wall by an F-channel receiver strips nailed to a pair of strandboard walls having a 90 degree outside corner. The cornice molding strip was Cornice Molding, Product Code 55807, available from CertainTeed Corporation, Valley Forge, Pa. The receiver strip was Deluxe F-Channel, Product Code 52503, available from CertainTeed Corporation, Valley Forge, Pa. These experiments will now be described as Examples 1, 2 and 3. The same cornice molding strips and receiver strips were used in each of the examples. The experiments were carried out at ambient temperatures. These examples are provided to better disclose and teach articles and methods of the present invention. They are for illustrative purposes only, and it must be acknowledged that minor variations and changes can be made without materially affecting the spirit and scope of the invention as described herein.

Example 1

In a first trial, a force gauge with a hook was used to pull the cornice molding, in the absence of a cornice molding corner cap, from the receiver until the molding was dislodged from the receiver. The pulling force was directed perpendicularly away from the wall near the end of the molding strip. The force was measured to remove the molding from the receiver channel.

Example 2

Figure 16A:
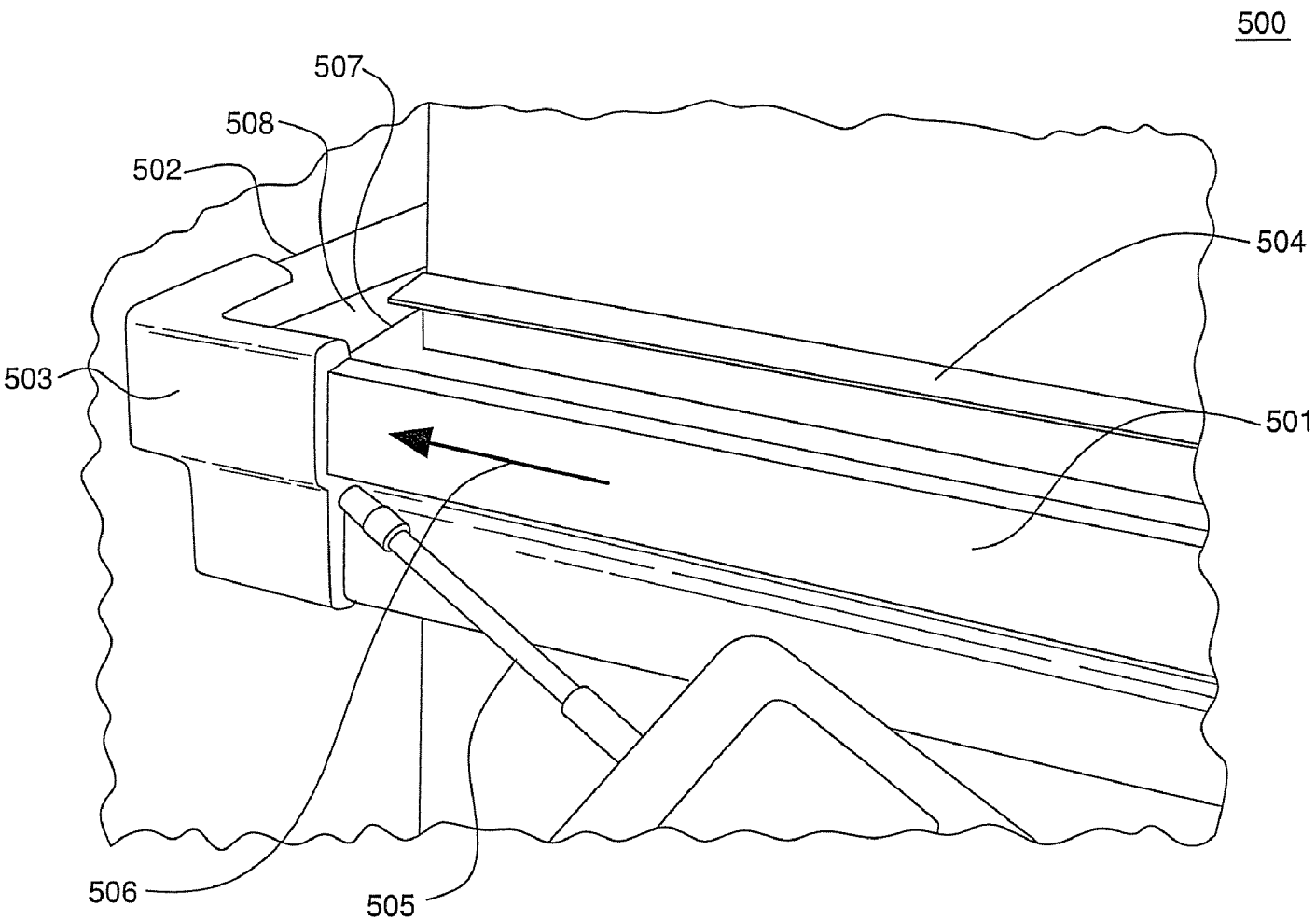
FIG. 16*a* is a perspective view of a lateral force resistance test performed on an assembly including receiver strips, cornice molding trim accessory strips, and an exemplary cornice molding corner cap according to the present invention mounted on a wall corner.
Figure 16B:
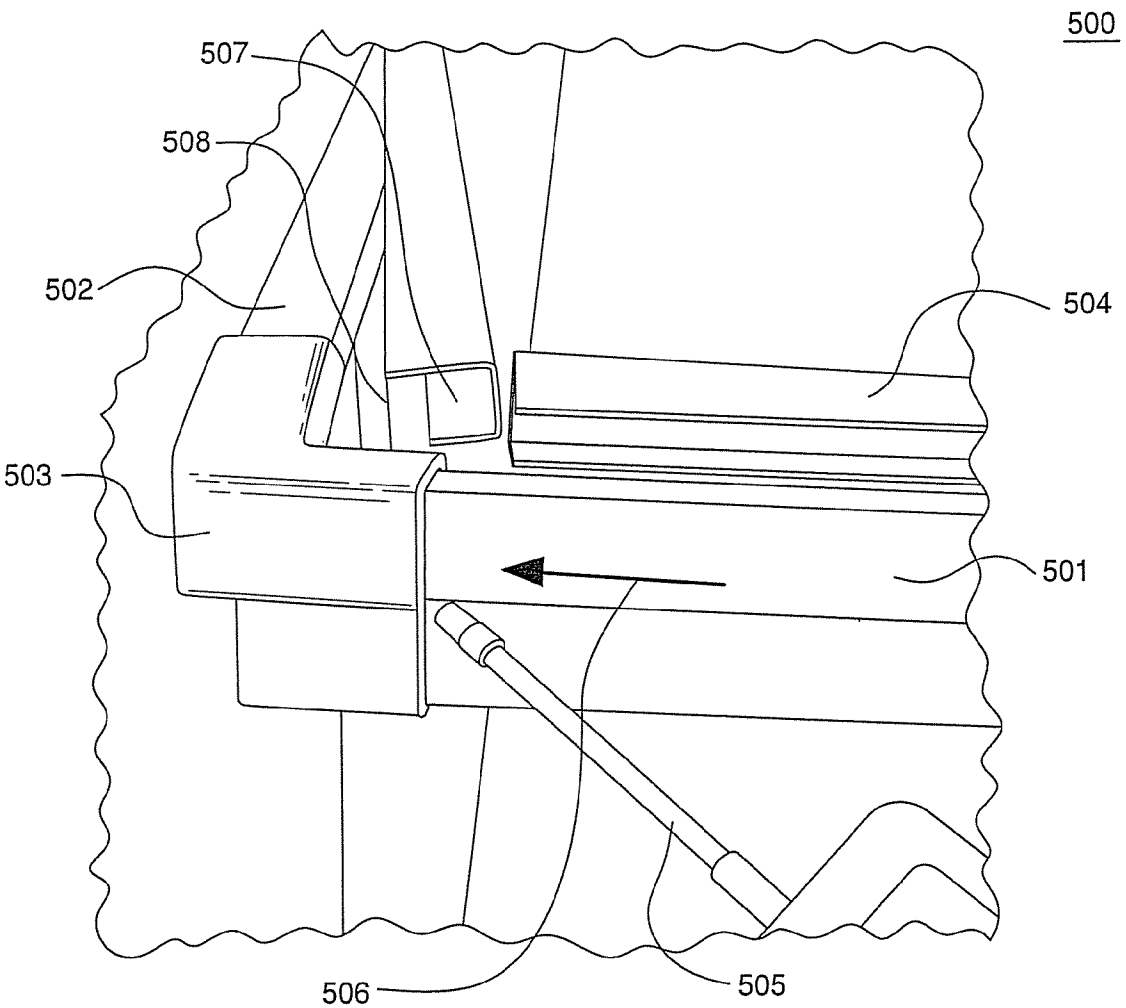
FIG. 16*b* is a perspective view of the test of FIG. 16 performed at a later stage of the lateral force resistance test.

In a second trial, a cornice molding corner cap of the present invention was installed over cornice molding accessory strips mounted to the wall using F-channel receiver strips nailed to the wall. A pushing force was imposed against the cornice molding corner cap at a lateral edge of the cap adjacent to one of the molding strips in a direction parallel to a first molding strip toward the end of the molding strip covered by the cap. The force was applied to the cap until either the cap was dislodged or the second molding strip, perpendicular to the direction of the applied force, was forced out of the receiver strip. A force transducer was used to measure the imposed force through the course of the test. FIGS. 16*a* and 16*b* depict the test in progress with assembly 500, FIG. 16*b* being slightly later during the test than FIG. 16. A first cornice molding strip 501 was mounted on the wall by receiver strip 504. Second cornice molding strip 502 was mounted on the adjacent wall around the corner by receiver strip 507. Cornice molding corner cap 503 was installed in place over the ends of the two cornice molding strips 501,502. Force transducer 505 was placed in contact with the edge of the corner cap and pushed in a direction indicated by the arrow 506. The force was applied until the cornice molding strip 502 was dislodged from its receiver strip 507 resulting in the separation gap 508.

Example 3

Figure 17A:
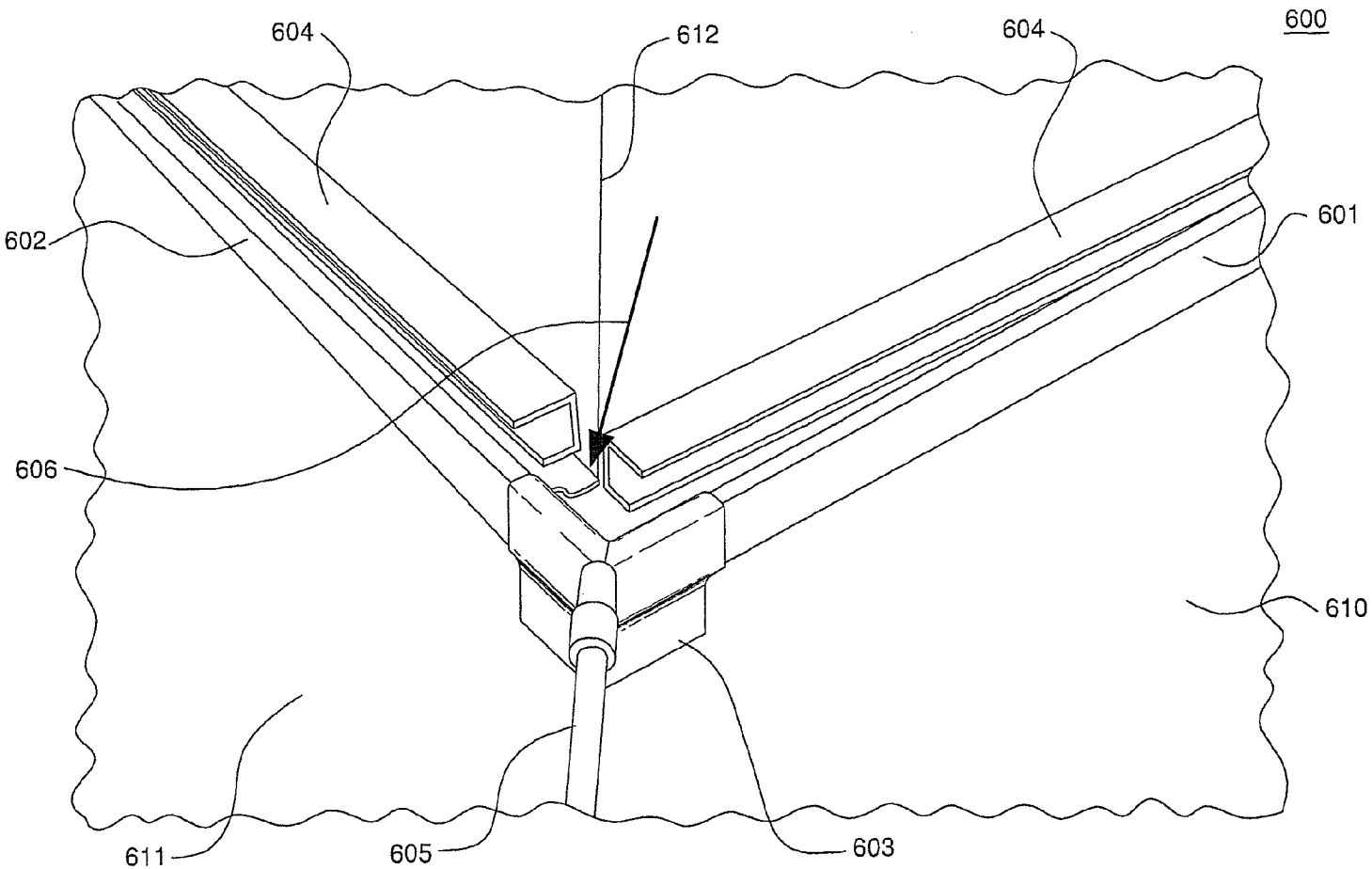
FIG. 17*a* is a perspective view of a tensile force resistance test performed on an assembly including receiver strips, cornice molding trim accessory strips, and an exemplary cornice molding corner cap according to the present invention mounted on a wall corner.
Figure 17B:
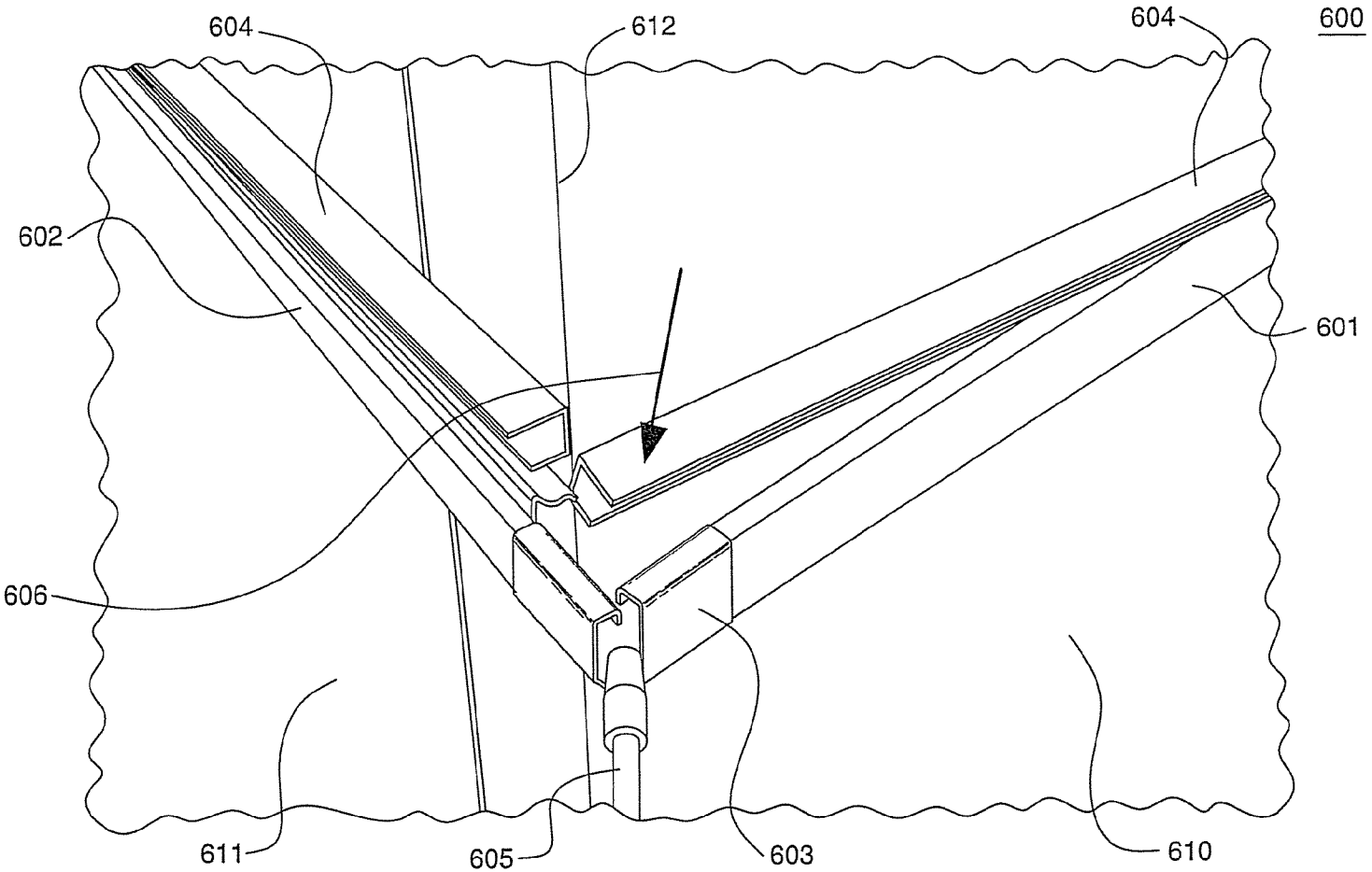
FIG. 17*b* is a perspective view of the test of FIG. 17 being performed at a later stage of the test.

In a third trial, a cornice molding corner cap of the present invention was installed over cornice molding accessory strips mounted to the wall using F-channel receiver strips nailed to the wall. A pulling force was imposed on the cornice molding corner cap using a force gauge with a hook fixture attached to the end of the force probe. The fixture was hooked over the top of the cap at the corner to engage a force on the cap. The force was imposed along an angle bisecting the legs of the corner and directly away from the wall. That is to say, the force was directed at an angle of 135 degrees from each of the two walls and in the same plane as the mounting of the two molding strips on the surface of the wall. The force was applied to the cap until either the cap was dislodged or at least one of the molding strips was forced out of its respective receiver strip. FIGS. 17*a* and 17*b* depict the test in progress with assembly 600, FIG. 17*b* being slightly later during the test than FIG. 17*a*. First and second cornice molding strips 601,602 were mounted on an outside wall corner 612 having a first wall 610 and a second wall 611, the walls having a 90 degree angle between the two walls at the corner 612, by receiver strips 604. Cornice molding corner cap 603 was installed in place over the ends of the two cornice molding strips 601,602. Force transducer 605 was equipped with hook fixture that was hooked around the top edge of the cap and pulled in a direction indicated by the arrow 606. The force was applied until the cornice molding strips 601,602 were dislodged from their receiver strips 607 resulting in a separation gap between the molding strips and the wall.

The results of the testing of examples 1 through 3 are reported in the table below. The results provided in Table 1 show the estimated forces to dislodge either a cornice molding corner cap or a cornice molding strip.

TABLE 1

| Example | Average Force (lbs) | Type of Displacement |
|---|---|---|
| 1 | 7 | Cornice molding removed from receiver |
| 2 | 10 | Cornice molding removed from receiver* |
| 3 | 16 | Cornice molding removed from receiver* |

*could not measure force to remove cap

The results shown in Table 1 show that once the corner cap is installed, the corner cap is more resistant to displacement than the cornice molding strip itself under application of direct force in either a lateral pushing or pulling mode. Also, when the cornice molding corner cap is in place, it is more difficult to disengage the cornice molding strip from its receiver. The presence of the corner cap provides a more stable mechanical attachment means for the molding strip to the wall, resulting in a more stable trim application. Subsequent tests for blow off resistance under simulated high wind conditions were satisfactory for trim installations employing the cornice molding corner cap of the present invention.

Some dimensional aspects may be helpful in understanding the present invention. While the embodiment portrayed in a number of the figures has a height of about 2.6 inches and an upper face width of about 2 inches, other sizes are useful in accommodating cornice molding trims of various dimensions. Also, the retainer flange dimension requirements, some examples of which have been previously noted, will vary to adapt to the cornice molding strip configuration employed in an assembly, as well as to accommodate differences in flexural modulus of various materials that may be employed in producing the cornice molding corner caps of the present invention. In some embodiments, preferably the upper and lower retainer flanges 23,26 are between about 0.05 and 0.5 inch in dimension, more preferably about 0.1 to 0.3 inches.

With respect to thickness of the wall of the corner cap, in one especially preferred embodiment, the thickness of the shell of the main body corner cap is about 0.08 inch as measured at a lateral edge 20, although some embodiments may have a shell thickness in the range from about 0.01 inch to about 0.3 inch, more preferably from about 0.04 to about 0.1 inches. Thicker shells employ more material can be difficult to flex during installation of the cap. Thinner shells can be more fragile, and more susceptible to damage during handling or in use.

Visual aspects of the molding cap are also important in producing particularly aesthetically appealing embodiments. For example, it is preferred that the gloss be moderately low, so as to avoid excessive sheen or shiny spots when viewing the part at natural viewing angles. It is preferred the gloss be between 5 and 40 measured at 60 degrees, more preferably between 10 and 30, and even more preferably about 20. Both gloss and color should be such that the appearance of the molding cap is aesthetically pleasing when used in combination with a cornice molding strip, the molding strip having its own gloss and color attributes.

Presently preferred materials useful for producing or manufacturing of the cornice molding corner caps are thermoplastic polymers, although thermoset polymers could be employed. Particularly preferred thermoplastics include polyvinyl chloride (PVC) polymers and copolymers, polypropylene (PP) polymers and copolymers, polyethylene polymers and copolymers, acrylonitrile butadiene styrene (ABS) copolymers, acrylonitrile styrene acrylate (ASA) copolymers, acrylonitrile/ethylene-propylene-diene monomer (EPDM) rubber/styrene (AES) copolymers, and mixtures thereof. PVC, PP and ASA polymers are especially preferred, ASA based polymers even more so for darker colored articles, for example articles having a color with a value of L* in the 1976 CIE L*a*b* color scale of less than about 50. Polymer composite materials such as PVC or polyolefin polymers or copolymers filled with wood fiber or flour or a cellulose based fiber may also be employed in corner caps of the present invention. In some embodiments, it is desirable to use a first material having good weatherability as an outer layer on the exterior surface of the corner cap and a second material of lesser durability or weatherability, but providing a balance of more favorable economics or bulk material properties as the main portion of the corner cap body, disposed so as to be protected from the elements by the outer layer. As an example, some embodiments may employ a capstock of an ASA or AES based polymer over a core based on PVC polymers. Another exemplary approach would be to use a core formulated with a polymer having less expensive fillers and a capstock formulated with higher levels of light stabilizers and antioxidants. Recycled materials could be employed in part, or in whole, for such a main portion. Organic or inorganic coatings may also be useful for protective and/or decorative purposes as an outer layer of the corner cap. Such outer layers may be uniform in color or texture or may have variations or variegations for aesthetic effect. Other components useful in producing the corner caps are known in the art such as flow aids, modifiers, heat stabilizers, antioxidants, light stabilizers, colorants, pigments, fillers and the like. Colorants include both pigments and dyes. Light stabilizers include hindered amines and antioxidants include hindered phenols.

A variety of processes can be used to produce cornice molding corner caps of the present invention. These processes include typical ways of forming polymer materials into three dimensional shapes. Such processes include molding, forming, extrusion, coextrusion, compression molding, stamping, vacuum forming, injection molding, coinjection molding, casting, coating, foaming and the like, injection molding and vacuum forming being particularly preferred. Combinations of one or more of the aforementioned processes could also be employed, such as, for example, extrusion or coextrusion followed by vacuum forming or compression molding. Foaming could be with conventional blowing agents, such as chemical or physical blowing agents, or could be a microcellular foaming.

It will be understood that although the elements shown in the figures are relatively plain-surfaced, they may be shaped and decorated in any desired manner consistent with their interrelational functioning as described herein. Such decorations could include colors, appliqués, beveling, molding, shaping and the like, or other aesthetic treatments.

It will also be understood that by inverting the face of the structure through a symmetry plane transecting the corner of the cornice molding corner cap, an inside corner may be produced. That is to say that the angle between the decorative exterior faces of the corner cap could be about 90 degrees, rather than the approximately 270 degree angle shown in some of the figures included with this specification. In such an inside corner cap, the angle between the inside faces of the cap could be about 270 degrees as compared with the angle shown in some of the drawings being about 90 degrees. An inside corner could involve an angle of 90 degrees, or some other angle as desired for matching architectural detail, for example, having a larger angular sweep in a bay window area application, or a smaller angular sweep in an acute angular architectural detail. Similarly, the angle of an outside corner piece according to the invention could take on a range of values to accommodate architectural features encountered in a building structure.

Various other modifications can be made in the details of the various embodiments of the processes, compositions and articles of the present invention, all within the scope and spirit of the invention.

This description of the exemplary embodiments is intended to be read in connection with the accompanying drawings, which are to be considered part of the entire written description. In the description, relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What is claimed is:

1. A method of finishing an uppermost course of exterior siding installed at a corner of a building with a cornice molding comprising:

installing a pair of cornice molding trim accessory strips capable of sliding horizontally in receiver channels of cornice receiver strips secured to respective walls of a building that meet at a corner of the building such that the cornice molding trim accessory strips cover a portion of the uppermost course of siding installed at the corner, the cornice receiver strips each being formed into a unitary fastening flange along the cornice receiver strip to fasten to and along one of the corresponding building walls above the uppermost course of exterior siding installed on said one of the corresponding building walls, and each being formed into a unitary ledge along the cornice receiver strip and each being formed under the unitary ledge into a unitary receiver channel and a unitary retainer flange along the cornice receiver strip;

each of the cornice molding trim accessory strips is formed into a corresponding unitary mounting flange along the cornice molding trim accessory strip to be received in a corresponding unitary receiver channel formed under the unitary ledge of the cornice receiver strip and retained by a corresponding unitary retainer flange, wherein each of the cornice molding trim accessory strips is formed into a depending unitary bottom along the cornice molding trim accessory strip, the unitary bottom being flexible to conform against surface dimension irregularities on the uppermost course of exterior siding installed on said one of the corresponding building walls without causing a noticeable gap, wherein each of the cornice molding trim accessory strips provides a resiliently biased cantilever beam biased by cantilever beam resiliency to engage the uppermost course of exterior siding installed on said one of the corresponding building walls, and wherein each of the cornice molding trim accessory strips is formed into a unitary raised upper lip along the corresponding unitary mounting flange to abut the soffit and to attach a cornice molding corner cap without entering the corresponding receiver channel formed under the ledge of a cornice receiver strip; and snap fitting a cornice molding corner cap onto the pair of cornice molding trim accessory strips with the cap being in front of and concealing respective ends of the cornice molding trim accessory strips, while the respective ends are spaced apart from each other at an interior corner of a body portion of the cap to allow for expansion and contraction without engaging each other and without abutting the interior corner, wherein the cornice molding corner cap comprises a cap body portion formed into a unitary pair of receiver channels each defined between a hook-shaped unitary upper retaining flange and a hook-shaped unitary lower retaining flange, each said flange extending to an interior corner of the cap body portion and extending laterally of the cap body portion to receive and overlap a corresponding cornice molding trim accessory strip, such that the lower retainer flanges are so constructed and arranged to fit over and cover the depending bottoms along the cornice molding trim accessory strips without a visibly noticeable gap, and the upper retainer flanges are so constructed and arranged to fit over and along the raised upper lips along the cornice molding trim accessory strips, while wedged between the cornice molding trim accessory strips and the soffit without opening a noticeable gap, and the upper and lower retainer flanges are so constructed and arranged to receive the cornice molding trim accessory strips therebetween without fasteners therethrough to allow for horizontal expansion and contraction of the cornice molding trim accessory strips slidably relative to the body portion.

2. The method of claim 1, further comprising:

hooking the upper retainer flanges of the cornice molding corner cap over upper lips on respective cornice molding trim accessory strips and pivoting the cap to snap-fit lower retainer flanges over a bottom on the respective cornice molding trim accessory strips to mount the cap in place in a snap-fitting relation.

3. The method of claim 1, further comprising:

sliding the cornice molding corner cap over the end of one of the cornice molding trim accessory strips until the cap overlaps and aligns with a surface of the other of the cornice molding trim accessory strips; and snap fitting the cap over the other of the cornice molding trim accessory strips.

4. A method of using an assembly, the assembly providing a cornice for abutting a soffit and covering an uppermost course of exterior siding installed on corresponding building walls that meet at a corner of a building, comprising:

installing a pair of cornice molding trim accessory strips slidably horizontal in receiver channels of cornice receiver strips secured to respective walls of a building that meet at a corner of the building such that the cornice molding trim accessory strips cover a portion of the uppermost course of siding installed at the corner, the cornice receiver strips each being formed into a unitary fastening flange along the cornice receiver strip to fasten to and along one of the corresponding building walls above the uppermost course of exterior siding installed on said one of the corresponding building walls, and each being formed into a unitary ledge along the cornice receiver strip and each being formed under the unitary ledge into a unitary receiver channel and a unitary retainer flange along the cornice receiver strip;

each of the cornice molding trim accessory strips is formed into a corresponding unitary mounting flange along the cornice molding trim accessory strip to be received in a corresponding unitary receiver channel formed under the unitary ledge of the cornice receiver strip and retained by a corresponding unitary retainer flange, wherein each of the cornice molding trim accessory strips is formed into a depending unitary bottom along the cornice molding trim accessory strip, the unitary bottom being flexible to conform against surface dimension irregularities on the uppermost course of exterior siding installed on said one of the corresponding building walls without causing a noticeable gap, wherein each of the cornice molding trim accessory strips provides a resiliently biased cantilever beam biased by cantilever beam resiliency to engage the uppermost course of exterior siding installed on said one of the corresponding building walls, and wherein each of the cornice molding trim accessory strips is formed into a unitary raised upper lip along the corresponding unitary mounting flange to abut the soffit and to attach a cornice molding corner cap without entering the corresponding receiver channel formed under the ledge of a cornice receiver strip; and snap fitting a cap body portion of a cornice molding corner cap onto the pair of cornice molding trim accessory strips with the cap body portion being in front of and concealing respective ends of the cornice molding trim accessory strips, while the respective ends of the cornice molding trim accessory strips are spaced apart from each other at an interior corner of the cap body portion to allow for expansion and contraction without engaging each other and without abutting the interior corner, wherein the cornice molding corner cap comprises a cap body portion formed into a unitary pair of receiver channels each defined between a hook-shaped unitary upper retaining flange and a hook-shaped unitary lower retaining flange, each said flange extending to an interior corner of the cap body portion and extending laterally of the cap body portion to receive and overlap a corresponding cornice molding trim accessory strip, such that the lower retainer flanges are so constructed and arranged to fit over and cover the depending bottoms along the cornice molding trim accessory strips without a visibly noticeable gap, and the upper retainer flanges are so constructed and arranged to fit over and along the raised upper lips along the cornice molding trim accessory strips, while wedged between the cornice molding trim accessory strips and the soffit without opening a noticeable gap, and the upper and lower retainer flanges are so constructed and arranged to receive the cornice molding trim accessory strips therebetween without fasteners therethrough to allow for horizontal expansion and contraction of the cornice molding trim accessory strips slidably relative to the body portion.

5. The method of claim 4, further comprising:

hooking the upper retainer flanges of the cornice molding corner cap over upper lips on respective cornice molding trim accessory strips and pivoting the cap to snap-fit the lower retainer flanges over a bottom on the respective cornice molding trim accessory strips to mount the cap in place in a snap-fitting relation.

6. The method of claim 4, further comprising:

sliding the cornice molding corner cap over the end of one of the cornice molding trim accessory strips until the cap overlaps and aligns with a surface of the other cornice molding trim accessory strips; and snap fitting the cap over the other cornice molding trim accessory strips.

* * * * *